US006499415B1

(12) United States Patent
Grant et al.

(10) Patent No.: US 6,499,415 B1
(45) Date of Patent: Dec. 31, 2002

(54) ZIGZAG SEWING MACHINE

(75) Inventors: Matthew M. Grant, Columbia City; Duane W. Crisp, Albion, both of IN (US)

(73) Assignee: Sailrite Enterprises, Inc., Columbia City, IN (US)

( * ) Notice: Subject to any disclaimer, the term of this patent is extended or adjusted under 35 U.S.C. 154(b) by 0 days.

(21) Appl. No.: 09/565,876

(22) Filed: May 5, 2000

(51) Int. Cl.[7] ..... D05B 3/02; D05B 3/04
(52) U.S. Cl. ..... 112/443; 112/320
(58) Field of Search ..... 112/447, 260, 112/235, 320, 192, 462, 467, 324, 315, 314

(56) References Cited

U.S. PATENT DOCUMENTS

| | | | | |
|---|---|---|---|---|
| 2,653,557 A | * | 9/1953 | Casas-Robert et al. | 112/462 X |
| 3,006,298 A | * | 10/1961 | Johnson | 112/192 |
| 3,221,689 A | * | 12/1965 | James | 112/260 |
| 3,701,308 A | | 10/1972 | Davis | |
| 3,952,675 A | | 4/1976 | Thompson | |
| 4,296,703 A | | 10/1981 | Thompson | |
| 4,323,020 A | | 4/1982 | Thompson | |
| 4,341,172 A | | 7/1982 | Thompson | |
| 4,539,925 A | * | 9/1985 | Shim | 112/314 |
| 4,699,072 A | | 10/1987 | Tsukioka | |
| 4,771,715 A | * | 9/1988 | Inagaki | 112/443 |
| 5,029,544 A | * | 7/1991 | Shimizu | 112/192 |
| 5,067,423 A | | 11/1991 | Thompson | |
| 5,074,231 A | | 12/1991 | Thompson | |

OTHER PUBLICATIONS

"Brewer Parts Bulletin." Oct. 1999, Bartlett, Tennessee.

"How To Make The Thompson Mini Walking Foot Sewing Machine Zigzag," Matthew M. Grant, Jul. 29, 1989, Sailrite Enterprises, Inc., Columbia City, IN.

"How To Make The Ultrafeed Zigzag," Matthew M. Grant, Jul. 29 1989, Sailrite Enterprises, Inc., Columbia City, IN.

* cited by examiner

*Primary Examiner*—Ismael Izaguine
(74) *Attorney, Agent, or Firm*—Krieg Devault Lundy, LLP

(57) ABSTRACT

A new and improved portable zigzag straight stitch walking foot sewing machine comprising a longer needle stroke, a larger presser foot having a radiused bottom, a throat plate having a larger opening therein, an inner presser foot having a relatively high lift permitting the easy insertion or removal of fabric which a new and improved spring loaded connecting rod that operates to prevent the fabric from being drawn into the presser foot opening and feed mechanism. In a specific embodiment, the new and improved portable zigzag straight stitch walking foot sewing machine includes a new and improved throw mechanism which is not biased and a retro fix stop device for reproducibly controlling the stitch length.

24 Claims, 23 Drawing Sheets

ZIGZAG SEWING MACHINE

BACKGROUND OF THE INVENTION

The present invention relates generally to a sewing machine, and more particularly to a zigzag sewing machine with a walking foot having remarkable performance with work pieces of extra thickness and reliability.

Sewing machines for both domestic and commercial use have been developed before which can be utilized with work pieces of extra thickness.

Sewing machines that straight stitch have been available for decades. Sewing machines that both straight stitch and zigzag are not as common, but have been produced for years. On most sewing machines, the presser foot simply holds the fabric down and all fabric movement is accomplished with a single, bottom feed dog. There are, however, a few machines that employ a better feeding system using a mechanical walking presser foot. The walking presser foot moves forward and back in time with the feed dog such that fabric is fed in a more consistent and aggressive manner. Sewing machines with walking feet that both straight stitch and zigzag are few and far between. However, both Pfaff Sewing Machine Company and Consew Sewing Machine Company have produced such machines. However, the Pfaff machine is designed for lightweight work and utilizes an upper foot that works behind the needle where it provides very little aid in accurately feeding heavy constructions. The Consew machine is intended for high speed industrial work and is not portable nor is it versatile. These machines are not suitable for portable work with heavy fabrics or a wide range of fabric types, thickness or finish.

Sewing machines for use in canvas work and sail making require excellent material feeding. Sail makers, tent makers and canvas workers utilized home sized straight stitch walking foot machines such as the Thompson mini walker PW301 or the Tacon 601 a home sized machine that would both straight stitch and zigzag but did not have a walking foot mechanism or larger semi-industrial machines which were not portable. Heretofore in using these machines with heavy fabrics, the use of basting tapes, staples and pins were recommended. Some improvements in the feeding of heavy fabrics could be gained by increasing the foot pressure on standard drop feed machines. However these machines do not have a walking upper foot making material feeding still inconsistent and those not capable of a zigzag stitch while satisfactory for canvas work were unsatisfactory for sail making.

It is therefore highly desirable to provide a new and improved straight stitch/zigzag portable sewing machine having a walking foot that can be utilized to sew heavy, thick fabrics with remarkable performance and reliability. It is also highly desirable to provide a new and improved portable straight stitch/zigzag walking foot sewing machine that allows for thick, heavy fabrics to be controllably fed which will not jam because of penetration by the needle in transport. It is also highly desirable to provide a new and improved straight stitch/zigzag portable walking foot sewing machine that can be utilized to sew heavy, thick fabrics without the fabric being drawn down into the presser foot opening and jamming or contributing to skipped stitches. It is also highly desirable to provide a new and improved straight stitch/zigzag walking foot sewing machine that retards the needles impact with the fabric surface. It is also highly desirable to provide a new and improved portable straight stitch/zigzag walking foot sewing machine that evenly feeds relatively thick material from side to side and front to back. It is also highly desirable to provide a new and improved portable straight stitch/zigzag walking foot sewing machine that decreases needle strikes.

In 1994, Datho Manufacturing, Inc., a company which produced the Thompson mini walker PW301 machine, attempted to develop a zigzag machine. A prototype of that machine however was totally unsatisfactory, for the following reasons: the width of the zigzag stitch was very narrow about 2.5 millimeters, about half the normal zigzag stitch; the needle bar, needle plate and lower feed dog did not meet properly; the machines did not sew well utilizing thick fabric assemblies or heavy fabric; the machine would skip stitches when zigzagging; and the zigzag stitch looked more like a Z than V. In 1998, a second prototype was produced in Taiwan, this prototype appeared similar to the Datho prototype but had similar problems and did not work. These problems included skipped stitches, inability to work with thick fabrics, miss shaping of the stitch to look more like a Z than a V, and the width of the zigzag was still too narrow.

Thus, it is also highly desirable to provide a new and improved portable straight stitch/zigzag walking foot sewing machine that provides for increased width in the zigzag stitch. It is also highly desirable to provide a new and improved portable zigzag straight stitch walking foot sewing machine that has a presser foot having a relatively high lift permitting the easy insertion and removal of fabrics of thicknesses measuring as much as 5/16 of an inch. It is also highly desirable to provide a new and improved portable straight stitch/zigzag walking foot sewing machine that focuses foot pressure on the needle plate when the needle is withdrawn thereby eliminating skipped stitches in heavy fabrics. It is also highly desirable to provide a portable straight stitch/zigzag walking foot sewing machine that allows sewing of complicated patterns with many twists and turns without thread jams. It is also highly desirable to provide a new and improved portable straight stitch/zigzag walking foot sewing machine in which heavy fabrics are pulled along accurately. It is also highly desirable to provide a new and improved straight stitch/zigzag walking foot sewing machine that includes a moveable bobbin thread basket. It is also highly desirable to provide a new and improved straight stitch/zigzag walking foot sewing machine that has a back stop in the stitch length lever slot to control stitch length. It is also highly desirable to provide a new and improved straight stitch/zigzag walking foot sewing machine that allows stitch length to be adjusted in a precise reproducible manner.

SUMMARY OF THE INVENTION

It is therefore an object of the invention to provide a new and improved straight stitch/zigzag portable sewing machine having a walking foot which can be utilized to sew heavy, thick fabrics with remarkable performance and reliability.

It is also an object of the invention to provide a new and improved portable straight stitch/zigzag walking foot sewing machine that allows for thick, heavy fabrics to be controllably fed which will not jam because of penetration by the needle in transport.

It is also an object of the invention to provide a new and improved straight stitch/zigzag portable walking foot sewing machine that can be utilized to sew heavy, thick fabrics without the fabric being drawn down into the presser foot opening and jamming or contributing to skipped stitches.

It is also an object of the invention to provide a new and improved straight stitch/zigzag walking foot sewing machine that retards the needles impact with the fabric surface.

It is also an object of the invention to provide a new and improved portable straight stitch/zigzag walking foot sewing machine that evenly feeds relatively thick material from side to side and front to back.

It is also an object of the invention to provide a new and improved portable straight stitch/zigzag walking foot sewing machine that decreases strikes.

It is also an object of the invention to provide a new and improved portable straight stitch/zigzag walking foot sewing that provides for increases width in the zigzag stitch.

It is also an object of the invention to provide a new and improved portable zigzag straight stitch walking foot sewing machine that has a presser foot having a relatively high lift permitting the easy insertion and removal of fabrics of thickness 5/16 of an inch.

It is also an object of the invention to provide a new and improved portable straight stitch/zigzag walking foot sewing machine that focuses foot pressure on the needle plate when the needle is withdrawn thereby eliminating skipped stitches in heavy fabrics.

It is also an object of the invention to provide a portable straight stitch/zigzag walking foot sewing machine that allows sewing of complicated patterns with many twists and turns without thread jams.

It is also an object of the invention to provide a new and improved portable straight stitch/zigzag walking foot sewing machine in which heavy fabrics are pulled along accurately.

It is also an object of the invention to provide a new and improved straight stitch/zigzag walking foot sewing machine that includes a moveable bobbin thread basket.

It is also an object of the invention to provide a new and improved straight stitch/zigzag walking foot sewing machine that has a back stop in the stitch length lever slot to control stitch length.

It is also an object of the invention to provide a new and improved straight stitch/zigzag walking foot sewing machine to allow stitch length to be adjusted in a precise reproducible manner.

It is finally an object of the invention to provide a new and improved straight stitch/zigzag walking foot sewing machine that has all of the above features.

In the broader aspects of this invention there is provided a new and improved portable zigzag straight stitch walking foot sewing machine comprising a longer needle stroke, a larger presser foot having a radiused bottom, a throat plate having a larger opening therein, an inner presser foot having a relatively high lift permitting the easy insertion or removal of fabric which a new and improved spring loaded connecting rod that operates to prevent the fabric from being drawn into the presser foot opening and feed mechanism. In a specific embodiment, the new and improved portable zigzag straight stitch walking foot sewing machine includes a new and improved hook driver that is not biased and a retro fix stop device for reproducibly controlling the stitch length.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
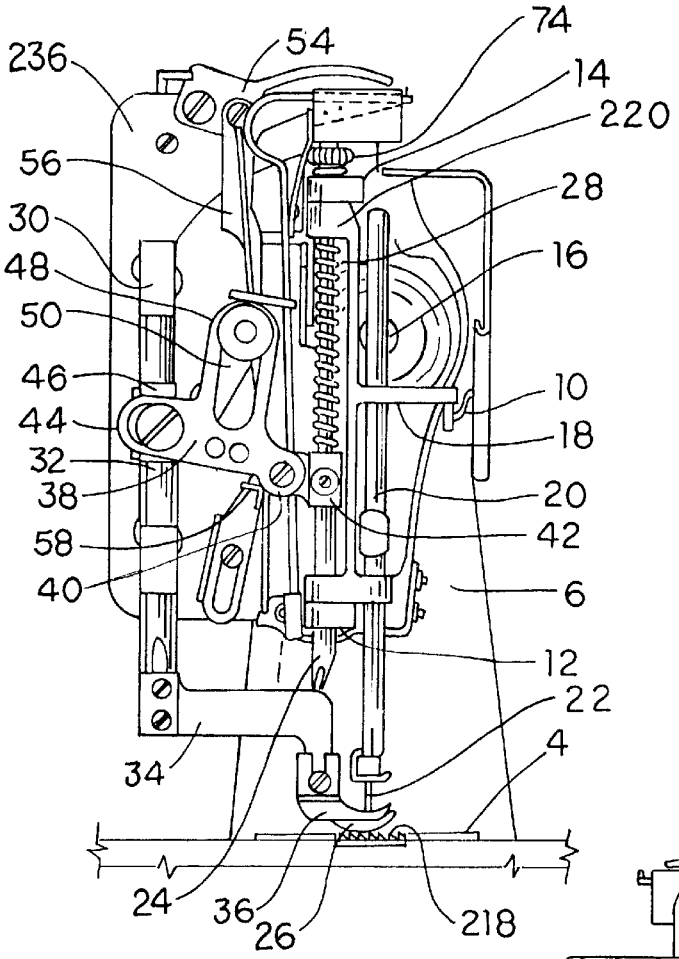
FIG. 1 is a front end elevation view of the sewing machine of the present invention.
Figure 2:
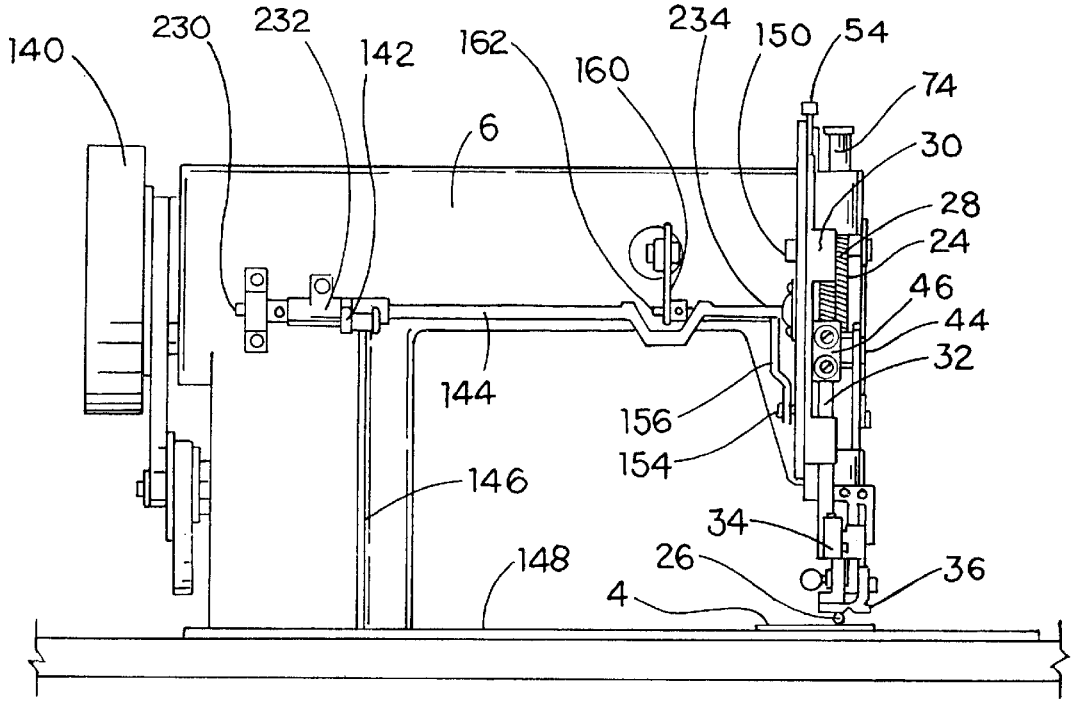
FIG. 2 is a side elevation view of the sewing machine illustrated in FIG. 1.
Figure 3:
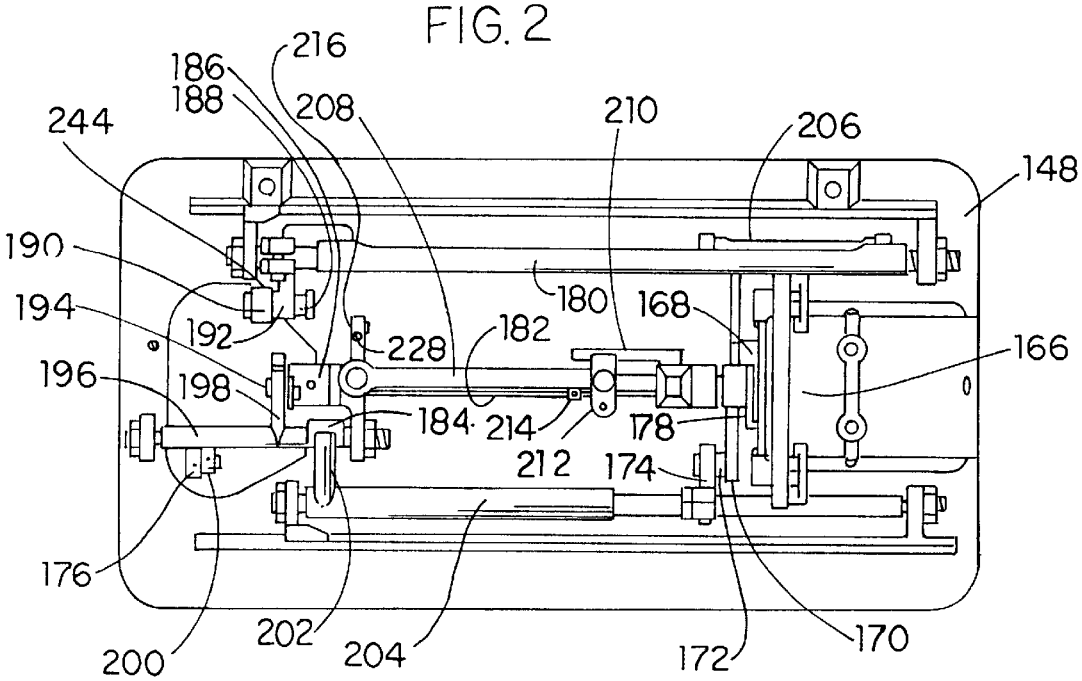
FIG. 3 is a bottom plan view of the sewing machine illustrated in FIG. 1.
Figure 14:
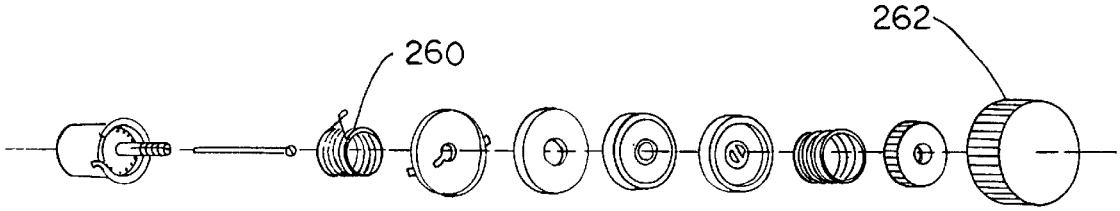
FIG. 14 is an exploded view of the upper tension assembly detail.
Figure 8:
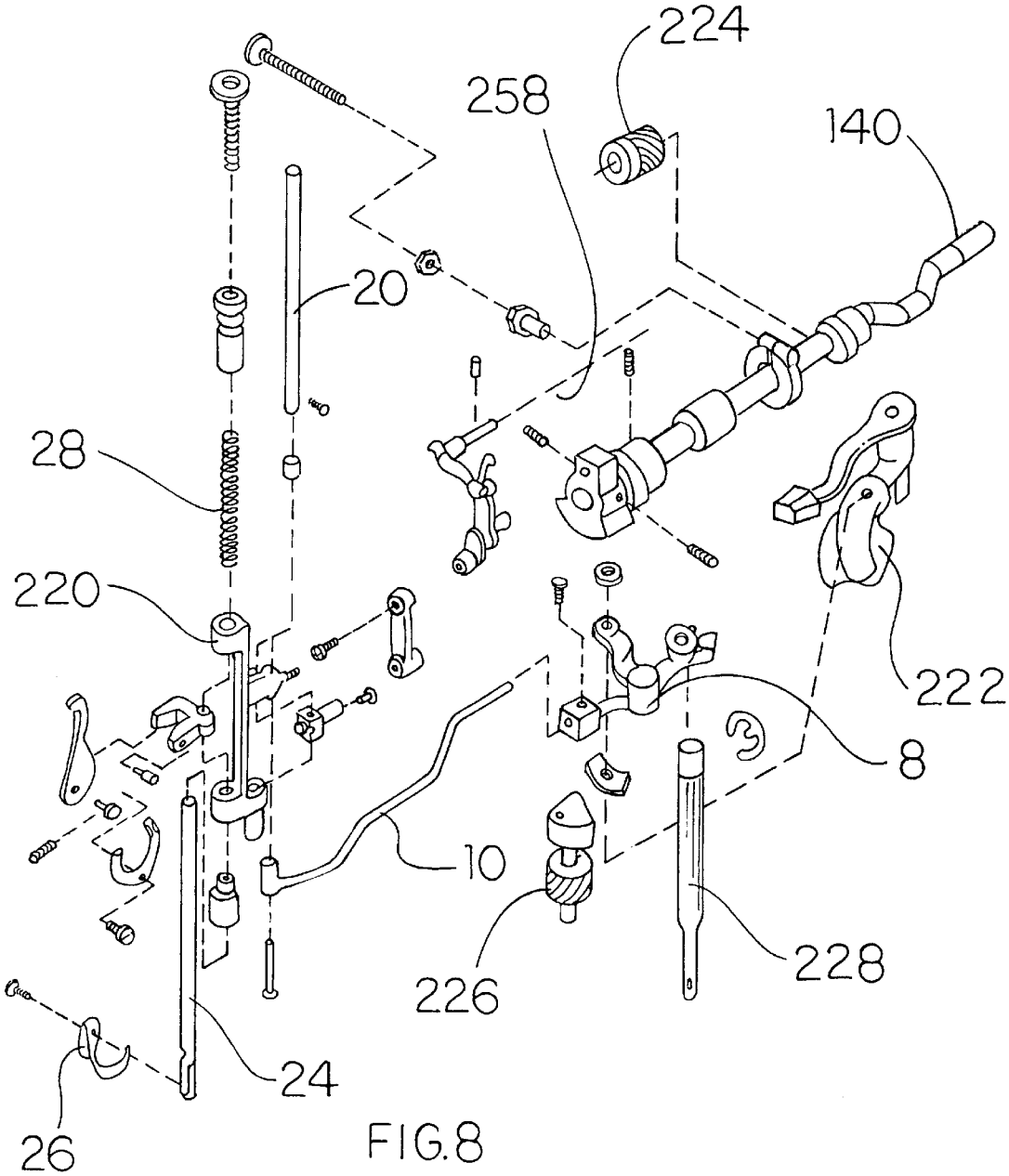
FIG. 8 is an exploded view of the sewing transmission parts of the sewing machine illustrated in FIG. 1.

With reference to FIGS. 1–5, a new and improved sewing machine is illustrated. Sewing machine 2 includes a housing 6. Contained within the housing 6 is a main crankshaft 140 (FIG. 8) that is coupled to a primary lift shaft (FIGS. 3 and 9) and a primary feed shaft 214 (FIGS. 3 and 10). The crankshaft drive wheel 141 (FIG. 2) is connected to one end of the main crankshaft for coupling either manual or powered drive to the main crankshaft. The primary lift shaft and the primary feed shaft are coupled to the main crankshaft so that they are moved thereby in a predetermined relationship to provide basic timed drive power to the remainder of the sewing machine lower feed elements.

FIG. 10 discloses a bottom workpiece feed mechanism comprised of a feed dog 218. Feed dog 218 is raised and lowered in response to movement by the primary lift shaft and is moved in a feed direction and the direction opposite thereto by movement of the primary feed shaft 244. See FIG. 10. The feed dog 218 has an upper serrated surface for gripping a work piece and feeding it through the sewing machine. The feed dog 218 is disposed within a workpiece supporting surface or needle plate 4. See FIG. 1.

Figure 9:
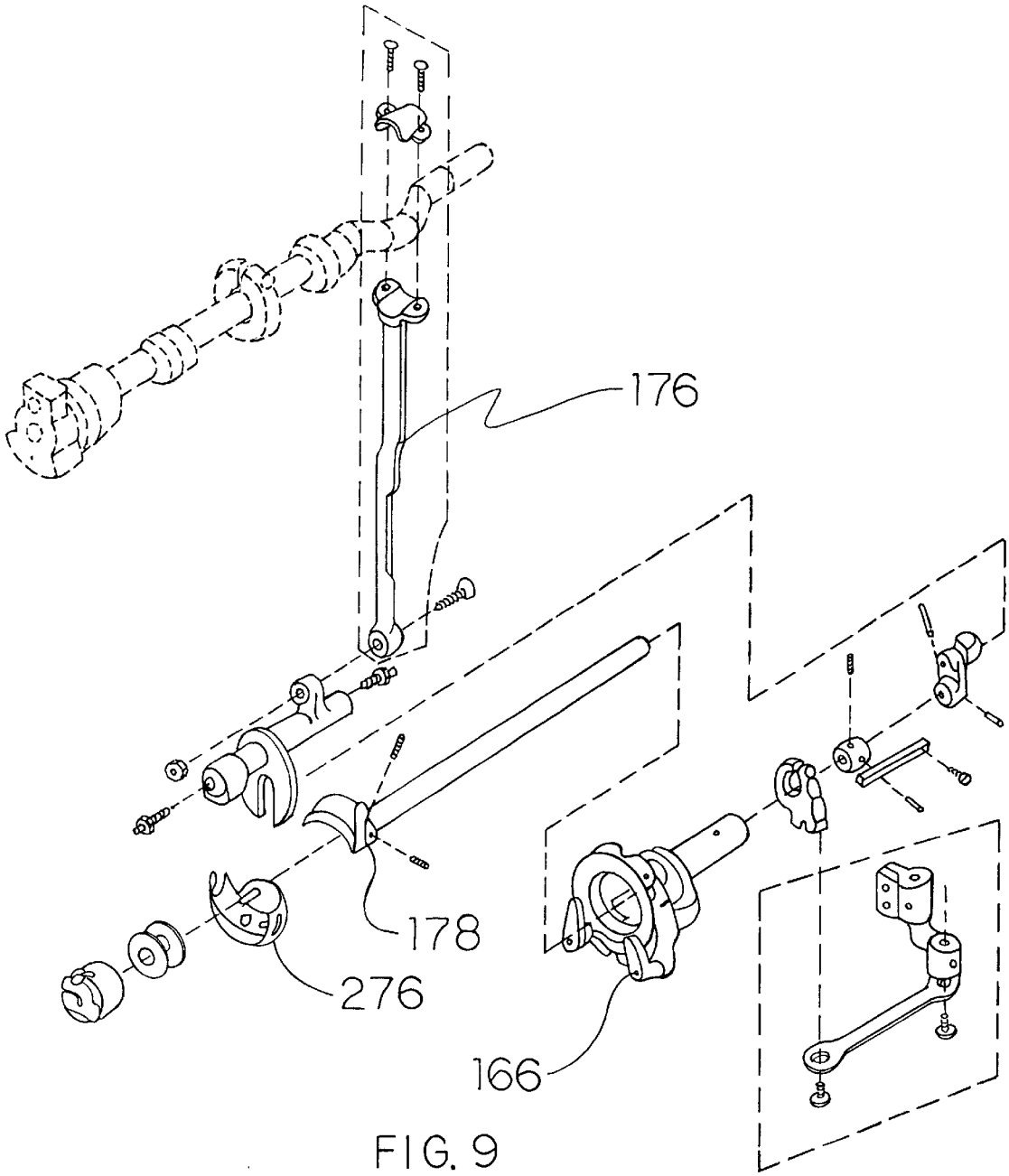
FIG. 9 is an exploded view of the shuttle transmission parts of the sewing machine illustrated in FIG. 1.
Figure 10:
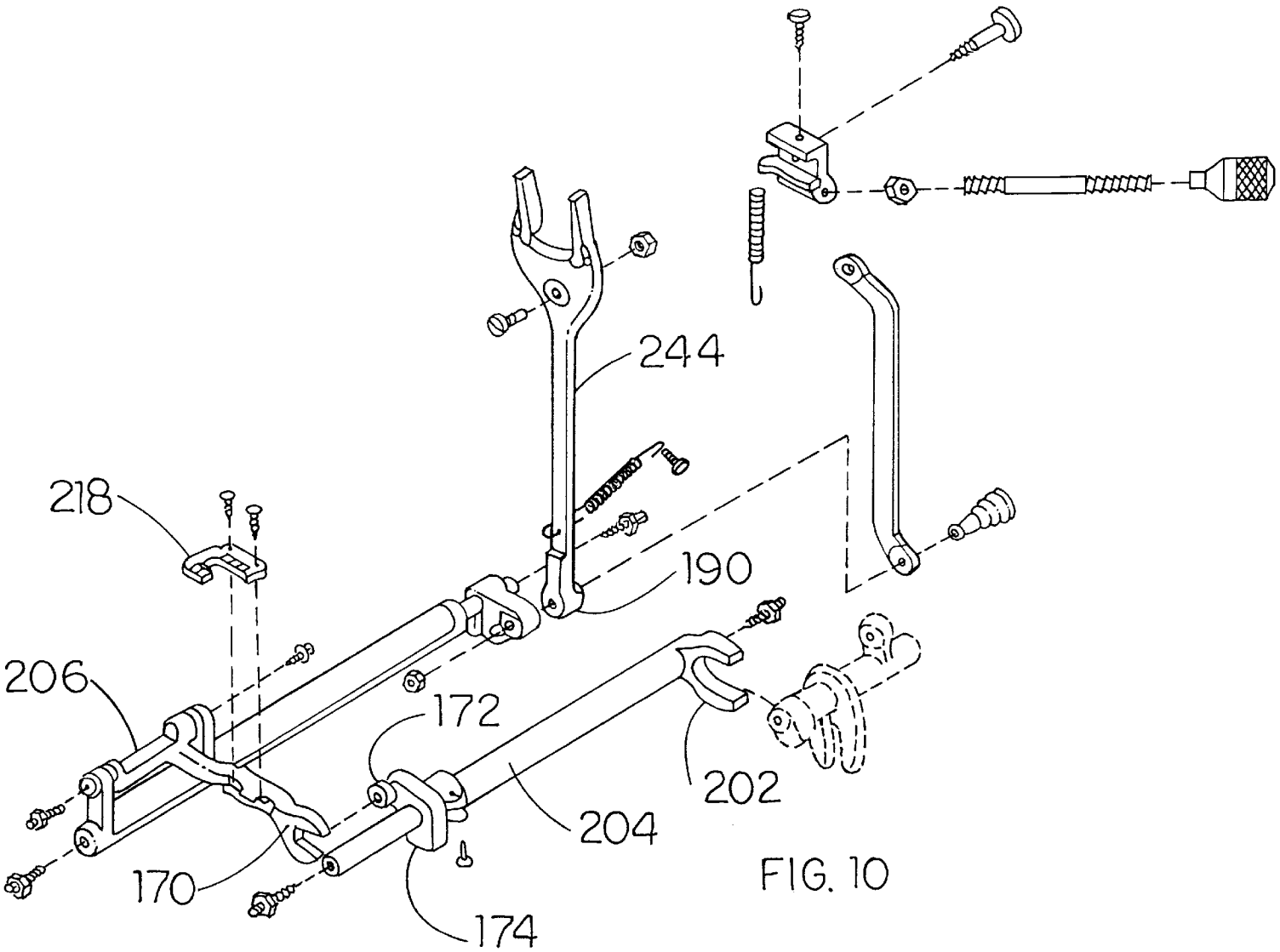
FIG. 10 is an exploded view of the feed transmission parts of the sewing machine illustrated in FIG. 1.

FIG. 9 further shows a hook and bobbin housing 166, which contains a hook 276 for catching thread fed by a needle and looping or throwing the thread around a bobbin 136 also contained in the housing 166.

Figure 12:
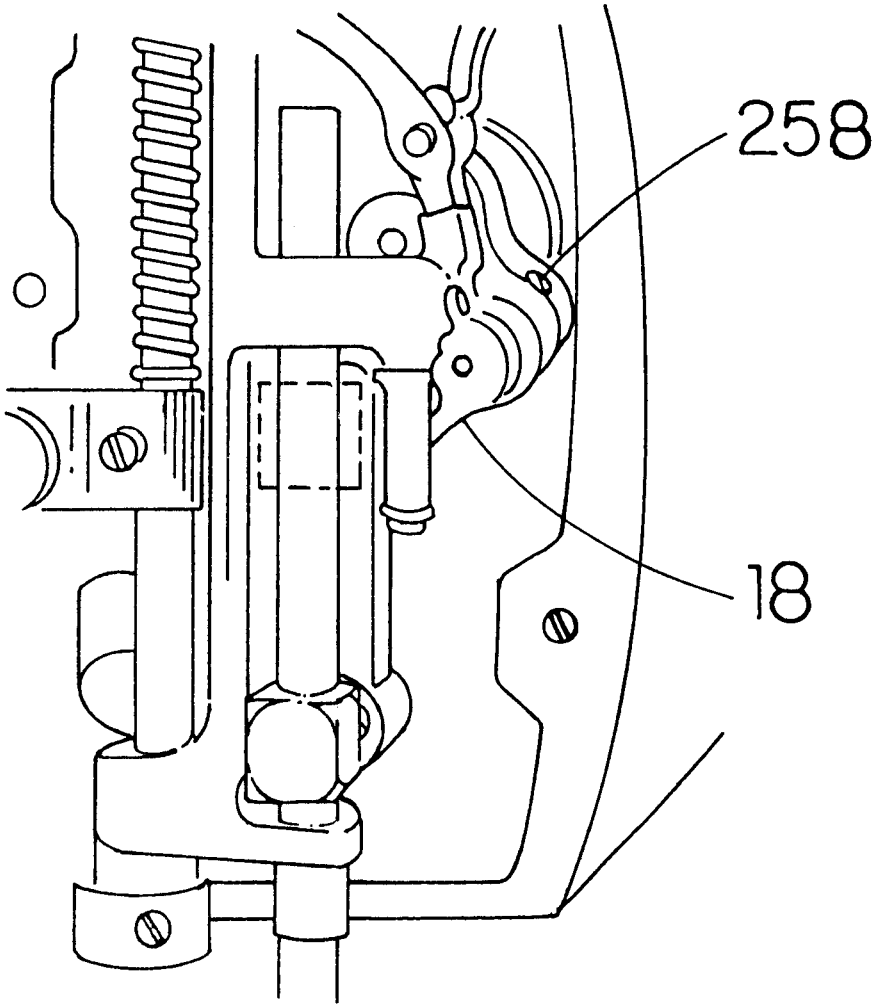
FIG. 12 is an enlarged view of the end elevation view of the sewing machine illustrated in FIGS. 1 and 2 illustrating the lowest travel position of the needle bar.

The sewing machine further includes a needle bar 20 having a needle 22 depending therefrom for effecting the stitching of the workpiece. See FIG. 1. The needle bar 20 and depended needle 22 are substantially vertically oscillated by a wheel and arm assembly 18 (FIG. 12) which operates in response to rotation of the main crankshaft 140. See FIG. 8.

Additionally, the machine includes a presser bar 24 (FIGS. 1 and 8) having a presser foot 26 connected thereto, which foot is normally retained in a lowered position to urge the work piece against the needle plate 4 and the workpiece supporting surface 148. The presser foot is forced against the needle plate by a spring 28 as shown in FIG. 1.

Frame 220 pivots on presser bar 24 to move the needle bar 20 and depending needle 22 back and forth. Frame 220 is driven by connecting rod 10. See FIGS. 1 and 8. Connecting rod 10 is secured to connecting link 8 in FIG. 8. Connecting link 8 is driven by a needle displacement regulator 222. Needle displacement regulator 222 is actuated by a helical gear 224 on the main crankshaft 140 driving through gear/cam 226. See FIG. 8. The cam portion of 226 drives needle displacement regulator 222 back and forth. The connecting link 8 is also responsible for the back and forth movement of the bobbin housing 166. Connecting link 8 clamps on vertical shaft 228 in FIG. 8 providing for this movement. Lower vertical shaft clamp 216 shown in FIG. 3 pivots back and forth moving connecting bar 208 which is secured to timing clamp 212. See FIG. 3. Timing clamp 212 is clamped to bobbin housing 166 which results in the latter's movement back and forth. Timing clamp 212 slides on shuttle guide shaft 210 keeping bobbin housing from turning. See FIGS. 3 and 9.

FIG. 1 discloses the means for connecting the needle bar 20 and a presser bar 24 to the sewing machine 2. The housing 6 has an upper and lower set of bores 12 and 14 through which presser bar 24 passes. See FIGS. 1 and 8. Between these housing bores 12 and 14 a frame 220 is situated through which presser bar 24 also passes. The C-frame 220 has four bores, two for the presser bar 24 and two for the needle bar 20. See FIG. 8. These bores in frame 220 extend substantially vertically allowing for two parallel shafts 20 and 24. Slidably received within respective ones of these bores are the needle bar 20 and the presser bar 24. In the specific embodiment these bars 20 and 24 are held by the housing 6 in substantially parallel spaced relation to each other. In the sewing machine 2, the presser bar 24 becomes a frame engaging leg extending upward from a presser foot 26 connected to the lower portion thereof a shown in FIG. 5.

Sewing machine 2 includes means for the moving needle bar back and forth with the shuttle hook making possible a zigzag stitch. This apparatus may also include a means for adjustably setting the amount of throw on the shuttle hook contained within the bobbin housing 166. See FIG. 9.

FIG. 2 shows the feed rod 146 which may be used to adjust the fore and aft travel range of the upper outer feed or walking foot 36. Feed rod 146 is linked to the primary feed shaft as will be shown later.

Figure 11:
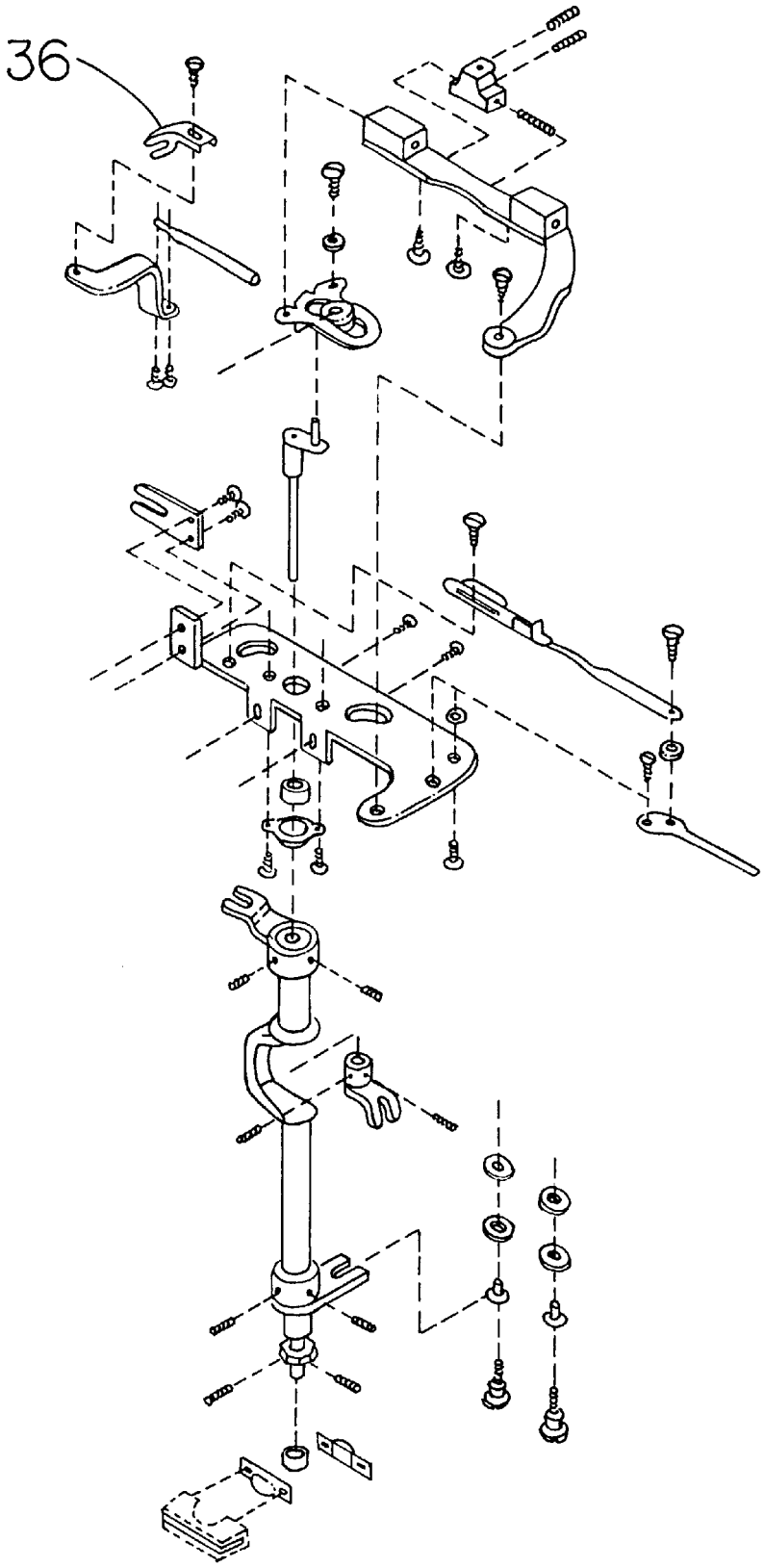
FIG. 11 is an exploded view of the driving and reversing mechanism parts of the sewing machine illustrated in FIG. 1.

This movement transmitting means more particularly includes a crank containing tube 144 having a first tube end 230 (FIG. 11) with which a first tube crank 232 is more closely associated and also having a second tube end 234 with which a second tube crank 156 (FIG. 5) is more closely associated. The first tube crank 232 is pivotally connected to the feed rod 146, and the second tube crank 156 is pivotally connected to the presser bar track guide screw 154 of the tubular member or presser bar track 30. See FIG. 11.

Figure 5:
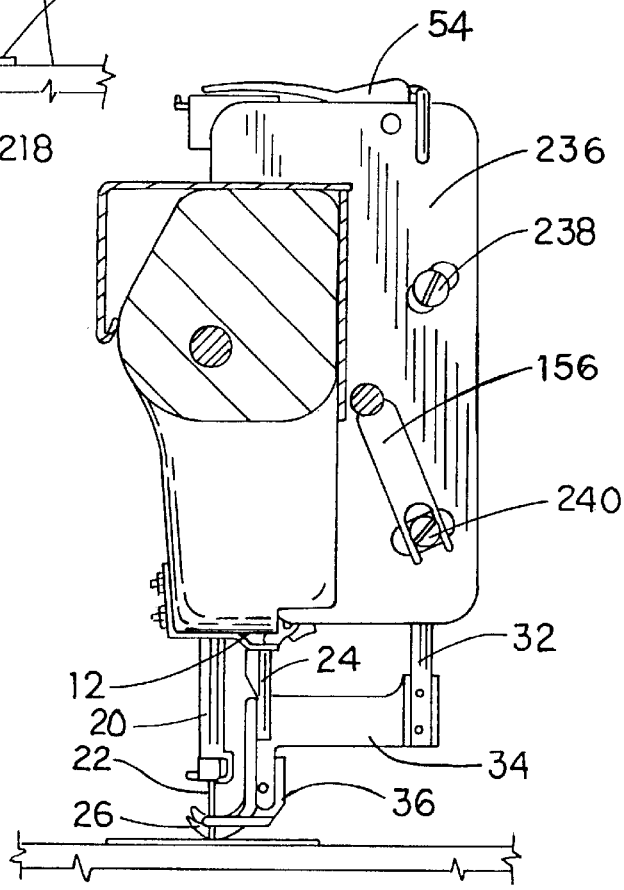
FIG. 5 is the back of the front end elevation view shown in FIG. 1.

The means for clamping the workpiece against the workpiece supporting surface or needle plate 4 during reverse feed direction pivotation is shown in FIG. 1 to include a second frame 236 connected to the sewing machine 2 by any appropriate mans, such as screws (not shown). The clamping means further includes a tubular member 30 which, in the illustrated embodiment, is connected substantially vertically to the second frame 236 by means of screws 238 and 240, shown in FIG. 5. Slidably engaged within the tubular member 30 is a workpiece walking foot rod 32. See FIGS. 1 and 11. Connected to the end of the workpiece walking foot rod 32 is a means for gripping the workpiece against the feed dog 218. In the embodiment shown in FIG. 1, this gripping means includes a walking foot 36 having an ankle member 34 extending therefrom for connection of the walking foot rod 32. Thus, in the embodiment shown in FIG. 1, the walking foot 36 depends from the walking foot rod 32. FIGS. 1, 2 and 5, collectively, indicate that the walking foot rod 32 has a substantially U-shaped configuration movably disposed around a substantial portion of the periphery of the presser foot 26. The walking foot 36 and the feed dog 218 are reciprocatingly moved in conjunction with one another to advance the workpiece during each stitching cycle.

FIG. 2 reveals that the clamping means further includes a lift rod 162 which is linked to the lift lever or presser bar actuator or up and down rocker 160 as subsequently described. The lift lever 160 allows for adjustment of the overall travel vertically of the walking foot 36.

The clamping means further includes a means for conveying movement by the lift lever 160 to the walking foot rod 32. This conveying means includes linkage means comprising a bell crank 38 having a first pivot end 40 connected to the presser bar 24 by attachment to a collar 42 of the presser bar 24 (FIG. 1), having a second pivot end 44 connected to the walking foot rod 32 by means of a block 46 thereof, and having a third pivot end 48. The third end 48 is pivotally connected to a means for communicating movement by the lift rod 162 to the third pivot end of the bell crank 38.

The means for lowering and raising the feed dog 218 is shown in FIG. 3 to include a feed dog elevation crank 174, a lever 204 and a means for transferring movement by the primary lift shaft 176 (FIG. 9) to the elevation crank 174.

The lever 204 includes a crank 174 and the feed dog 218. This connection to the feed dog 218 is made through a feed dog support arm 170 which has the feed dog 218 extending therefrom and which also has a forked end extending therefrom. The forked end communicates with a rotatable sleeve 172 or the crank 174.

The movement transferring means is a means for coupling the elevation crank 174 to the primary lift shaft 176. FIG. 3 indicates that this coupling is comprised of a fork 202 which pivots on a cam 184 mounted on a camshaft 196. The camshaft 196 is connected to an end 200 of the primary lift shaft 176 as shown in FIG. 3.

The means for the amount of throw on the hook 276, which is included in the apparatus of the present invention, includes a hook throw crank 194 shown in FIG. 3. The interaction between the hook throw crank 194 and the forked extension 198, as moved by the primary lift shaft 176, effects oscillatory rotation of a hook throw rod 182 and a throw mechanism 178 connected thereto.

The primary feed shaft has an end 190 shown in FIG. 3. The end 190 is coupled to an end 188 of a feed rod 146 (FIG. 1) and to a feed dog feed direction shaft crank 192. The feed dog feed direction shaft crank 192 is connected to a feed direction shaft 180. The feed direction shaft 180 is pivotally connected to the feed dog support arm 176 at a coupling 206 so that oscillation of the shaft 180 imparted from the primary feed shaft oscillates the feed dog 218 through its advancement and return during a workpiece direction of movement cycle.

FIG. 3 additionally shows that each of the previously discussed shafts disclosed therein are journaled in appropriate bearing structures which extend from the bottom of the workpiece supporting surface 148.

With reference again to FIG. 1, an additional feature will be described. This feature is the manual walking foot and presser foot lift mechanism. This mechanism has a lift lever 54 and a lift bar 56. The lift bar 56 has a lift shoulder 58 extending therefrom for contacting a flange extending from the rear of the bell crank 38 when lifting of the walking foot and presser foot elements is desired.

FIG. 1 further shows a spring 28 disposed over the upper portion of the presser rod or bar 24 between the upper housing bore and the collar 42. Connected to the top side of the upper housing bore from the spring 28 is a spring tensioning member 74.

In operation, the new and improved sewing machine 2 of the invention cycles through the following positions. In the FIG. 1 position of the assembly, the needle 22 is substantially in its lowest position, the feed dog is down and centered, the presser foot 26 is down and the walking foot 36 is up and centered. Rotating the assembly or thread take-up cam 16 draws the needle 22 upward, raises the feed dog up after moving the feed dog forward to the limit of its travel. The walking foot 36 moves down and contacts the feed dog which raises the presser foot 26. Rotating the assembly or thread take-up cam 16 into its FIG. 4 position moves the needle 22 upward to its zenith, and commences its next downward stroke, moves the feed dog 218 to the rear while maintaining it up, maintains the presser foot up and maintains the walking foot 36 down and moving rearward in conjunction with the feed dog 218. Rotation of the assembly or thread take-up cam 16 from its FIG. 4 position substantially completes the rearward pivotation of the walking foot 36, drives the needle 22 farther downward, moves the feed dog 218 backward while maintaining it up, maintains the walking foot down and slowly lowers the presser foot 26 down. As the assembly or thread take-up cam 16 rotates further, the needle 22 is driven through the workpiece to stitch it and the walking foot is pulled up, the feed dog 218 is moved forward while being retained down and the presser foot 26 remains down. In summary, the sewing machine functions so as the needle 22 is driven downward to penetrate and stitch the workpiece, the presser foot 26 is moved down to secure the workpiece against the needle plate 4, the walking foot is drawn upward due to the engagement of the presser foot with the workpiece and the feed dog 218 and the walking foot 36 are pivoted forward. Once forward, the walking foot moves down to engage the workpiece, the needle of the converted machine is retracted, the presser foot 26 is raised up and the feed dog 218 and walking foot 36 feed the workpiece back through the machine. The feed dog 218 and the walking foot 36 are then moved to the rear in preparation of the next cycle where they will again release the workpiece, stitch it and move forward once again to grip the workpiece.

Thus, it is apparent that the relative timing of the particular movements of various elements are critical. A portion of this timing difference is effected by the particular connection between the main crankshaft and the primary lift shaft 176 and the primary feed shaft 244 as well as the particular positioning of the cam 184. However, the primary timing differences are effected by the interaction of the previously described elements. This interaction will now be more particularly described.

Beginning with the wheel and arm assembly 16 as shown in FIG. 1, the converted sewing machine has just completed stitching and feeding the material through as indicated above in the step by step discussion. As the wheel and rim assembly 16 is rotated clockwise (as view in FIG. 1) the main crankshaft, moves the primary lift shaft downward. FIG. 3 indicates that as this occurs, the cam shaft 196 will be rotated so that the cam 184 engages the mounting shaft crank 202 which in turn rotates the mounting shaft 204 so that the feed dog elevation crank 174 pushed away from the underside of the workpiece supporting surface 148. This pivotation pulls the feed dog support arm 170 in the same direction so that the feed dog 218 is moved down from its FIG. 4 position.

Rotating the main crankshaft clockwise from the position viewed in FIG. 1 likewise rotates cam 242 as shown in FIG.

27. Cam 242 drives the bell crank 38 at the third pivot end 48 thereof. Main crankshaft rotation pivots the bell crank 38 about the first pivot end 40 so that the second pivot end 44 of the bell crank 38 moves downward to lower the walking foot 36 whereby the presser foot 26 is raised. Thus, the bell crank 38 converts the rotational movement of the crank 50 to vertical transitional movement. The needle 22 has been raised by the rotation of the thread take-up assembly 18 from its FIG. 1 position.

Figure 4:
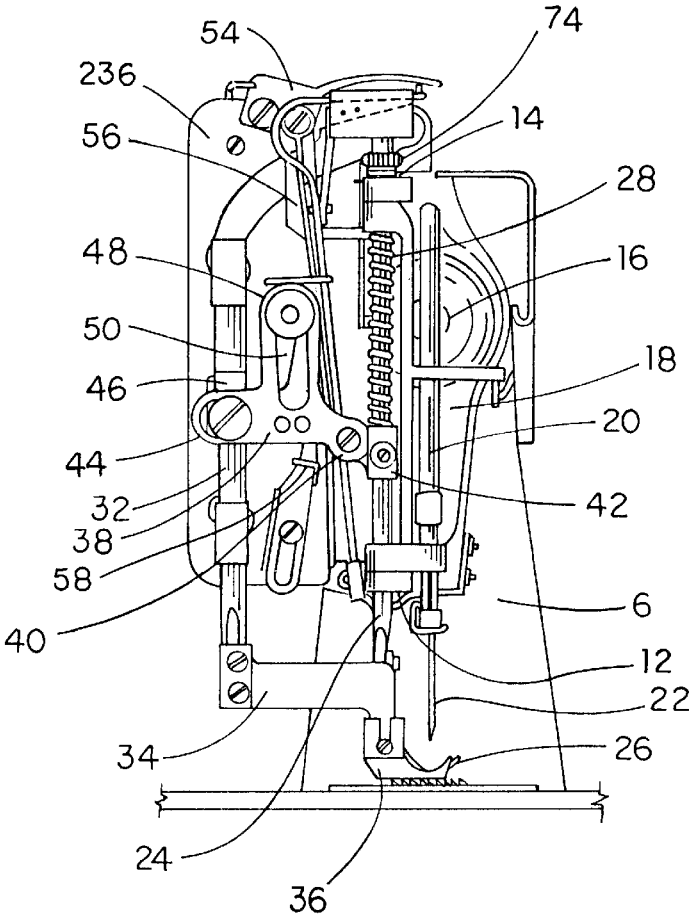
FIG. 4 is a front end elevation view of the sewing machine shown in FIG. 1, showing the element shown in a second position.
Figure 6:
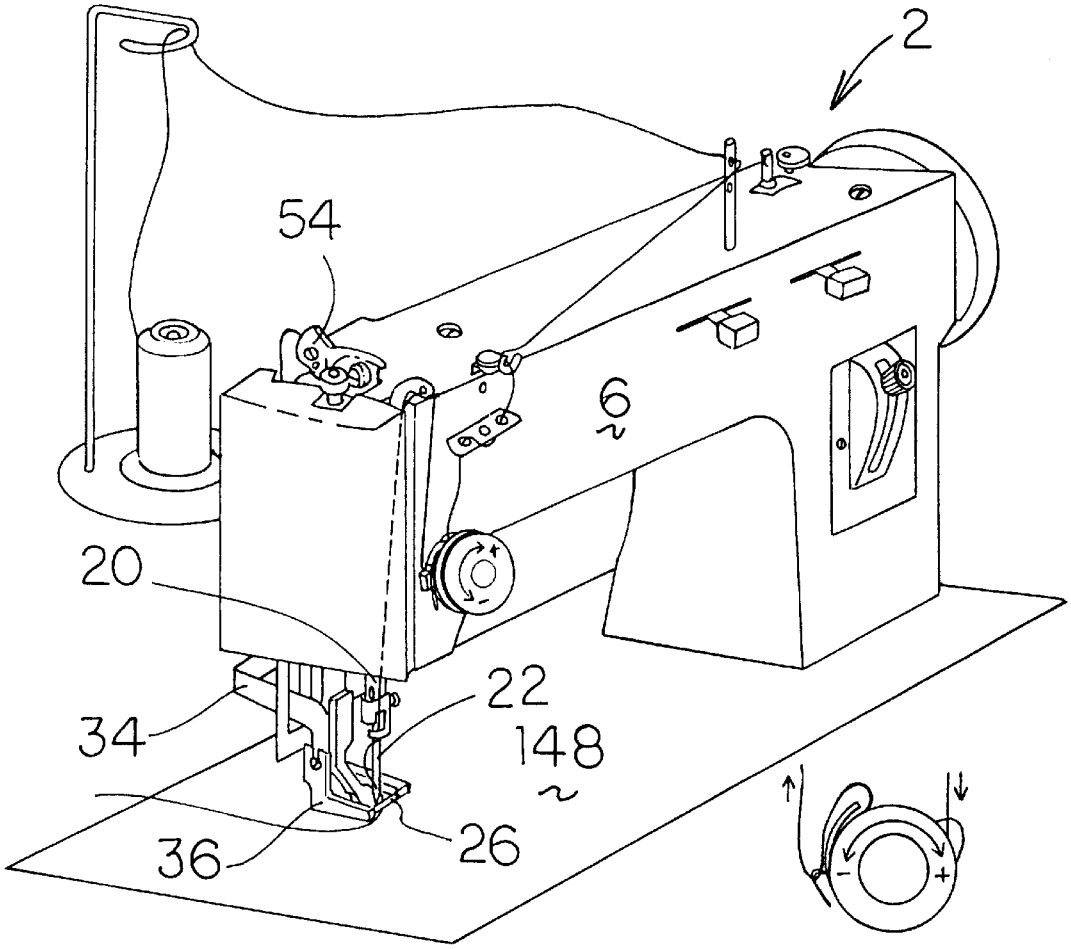
FIG. 6 is a perspective view of the sewing machine of the invention properly threaded.

As the thread take-up assembly 18 is rotated clockwise into its FIG. 4 position, the main crankshaft causes the primary lift shaft 176 to complete its downward travel and additionally moves the primary feed shaft end 190 to its downward most position. As shown in FIG. 4, movement of the primary feed shaft downward rotates the feed direction shaft crank 192 away from the underside of the workpiece supporting surface 148 to rotate the feed direction shaft 180 so that the connection indicated by the reference numeral 206 moves in a downward direction as viewed in FIG. 3. This movement drives the feed dog support arm 170 in the same direction so that the feed dog 218 moves to the front when the feed dog 218 is viewed from above. Thus, at this point where the thread take-up assembly 18 has been rotated approximately half of a complete revolution, the feed dog 218 is starting to move forward and up in preparation for its engagement with the workpiece and subsequently drawn to the rear in preparation of beginning a new stitch and feed movement.

In addition to moving the feed dog 218 to the front, the previously mentioned downward movement of the primary feed shaft 244 also moves the feed rod end 188 down. FIG. 2 indicates that when the feed rod end 188 is pulled down, this pulls the first tube crank 142 down and thereby rotates the crank containing tube 144. This rotation moves the second tube crank 156 in a clockwise direction as viewed in FIG. 5. This clockwise movement forces the walking foot 36 to move left as it is viewed in FIG. 5.

The ultimate position of the elements at the conclusion of the movement of the thread take-up assembly 18 to its FIG. 4 position are shown in FIG. 4.

Rotating the wheel and arm assembly 16 clockwise from its FIG. 4 position moves the elements into their next positions of the stitching cycle. In particular, during this portion of the rotation, the main crankshaft draws the primary lift shaft upward, which rotates the camshaft 196 and in turn, rotates the cam 184, the mounting shaft crank or fork 202 and the mounting shaft or lever 204 in the opposite direction from that in which they were rotated in moving from the FIG. 1 position. This movement moves the lever end or elevation crank 174 away from the underside of the workpiece supporting surface 4 which thereby lowers the feed dog support arm 176, the forked end 170 and the rotatable sleeve 172.

The next portion of the cycle completes the entire stitch, feed and return cycle when the thread take-up assembly 18 is moved back to its FIG. 1 position. As this rotation occurs, the main crankshaft 140 pulls the primary feed shaft 244 upward in addition to completing the upward movement of the primary lift shaft 176. This upward movement of the primary feed shaft 244 rotates the feed direction shaft 180 in the direction opposite that in which it was moved during its FIG. 4 portion of the cycle. That is, in moving to the FIG. 1 position, the connection 206 is rotated upward as shown in FIG. 3 so that the feed dog 218 is moved backward in the feed direction.

In addition to the preceding movements occurring during the various sectors of the rotation of the thread take-up assembly 18, the needle 22 is retracted from the sewn stitch and then driven downward to effect the next stitch. The relative positions of the needle 22 during the previously discussed portions of the cycle are shown in FIGS. 1 and 4.

With reference now to FIG. 3, a description of the operation of the adjustable hook throw mechanism 178 will be given. In general, the hook 276 is contained within the hook and bobbin housing 166 on the throw mechanism 178 and is oscillated by the primary lift shaft 176 acting through the forked extension 198 of the camshaft 196 and through the hook throw crank 186 and the hook throw rod 182 to first grab the thread which is pushed through the workpiece by the needle and to then pull the thread down for looping, or throwing, it around the bobbin so that the bobbin thread then extends through the interior of the loop. This is how the stitches of the needle fed thread are retained in the workpiece and is known by those having ordinary skill in the art.

Sewing machine 2 is provided with an improved needle stroke mechanism, an improved feed mechanism including an outer presser or walking foot 244, feed dog 218 mechanism and an inner presser foot 246 to feed thicker fabrics evenly from side to side and front to back. The inner presser foot 246 is further distinguished by its low profile making possible a relatively high lift permitting the easy insertion and removal of relatively thick fabrics.

Figure 27:
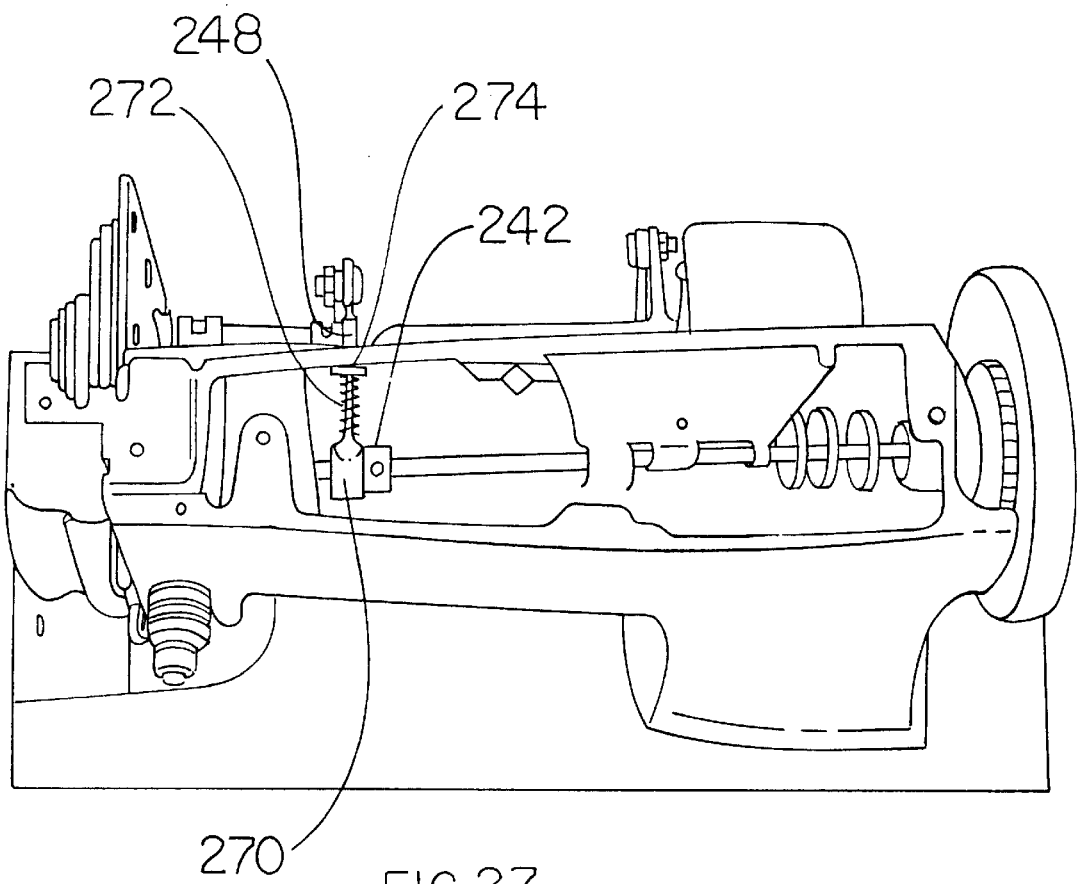
FIG. 27 is a top plan view of the sewing machine illustrated in FIG. 1 with the top cover removed.
Figure 28:
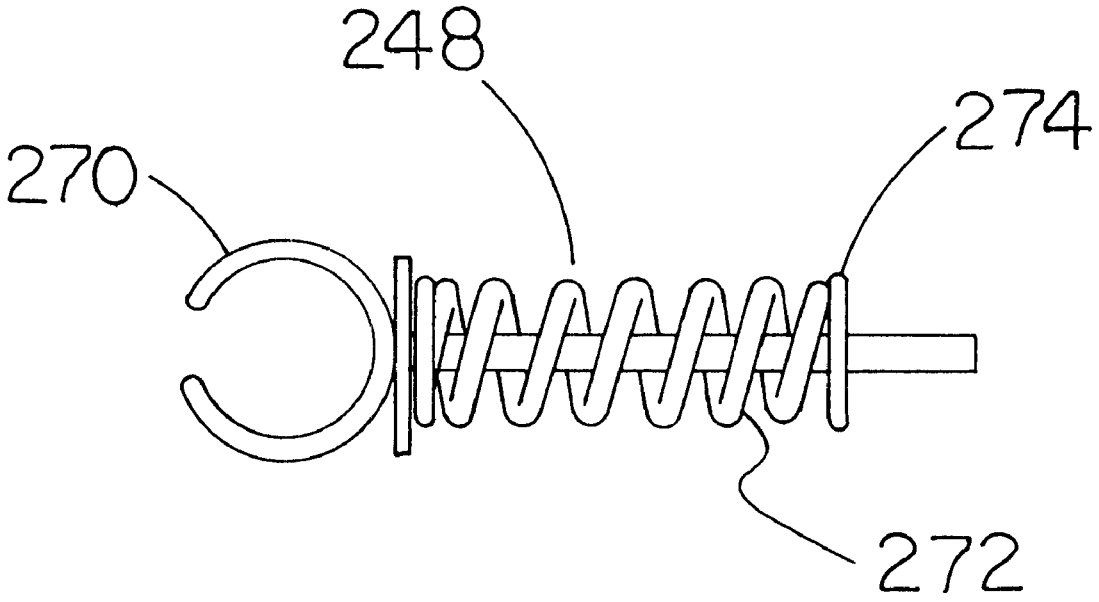
FIG. 28 is a side view:of the plate spring drive assembly for the walking foot.
Figure 29:
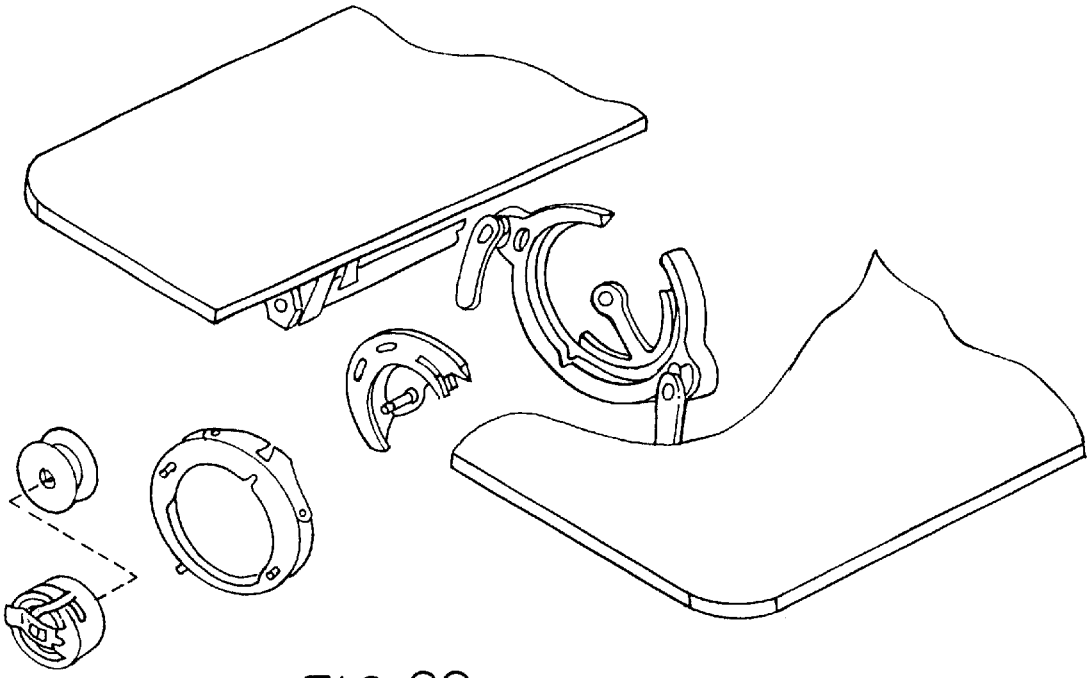
FIG. 29 is an exploded view of the bobbin shuttle hook and associated parts of the sewing machine illustrated in FIG. 1.

A spring loaded connecting rod to drive the walking foot 36 from front to back off the top shaft was created. A cam on the top drive shaft actuates the spring loaded connecting rod that pushes and pulls the feed mechanism. This quiets the machine and eliminates the play associated with a standard connecting rod 248 illustrated in FIG. 27.

Figure 22:
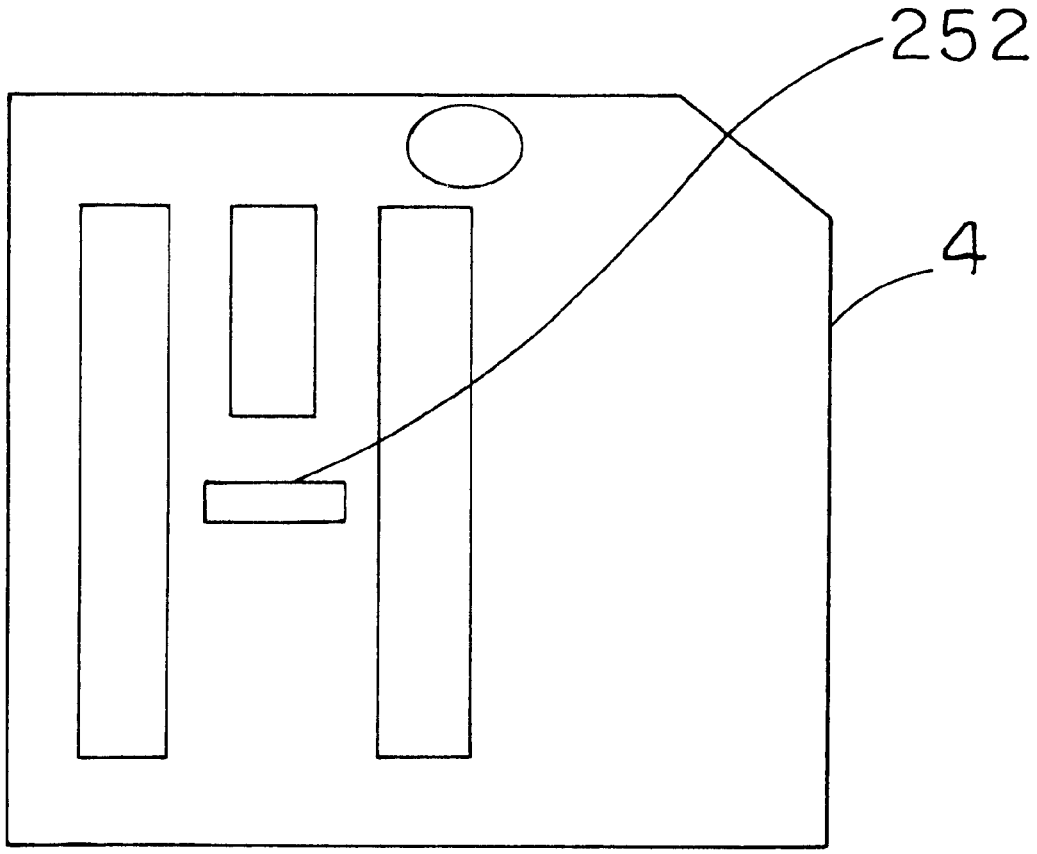
FIG. 22 is a close upon the needle plate of the invention.

In addition, the needle plate 250 is modified with a larger opening 252 to reduce needle strikes. See FIG. 22. This larger opening 252 was not previously taught or suggested as the fabric being sewed has a tendency of being pushed into the needle opening by the needle. The larger needle opening 252 is made possible by the inner 246 and outer 244 presser foot which focuses pressure on the slot and prevents the fabric from being drawn down into the opening. The fabric is in fact pinched both at the front and back of the opening by the presser foot 246 as the needle penetrates the fabric.

Figure 7:
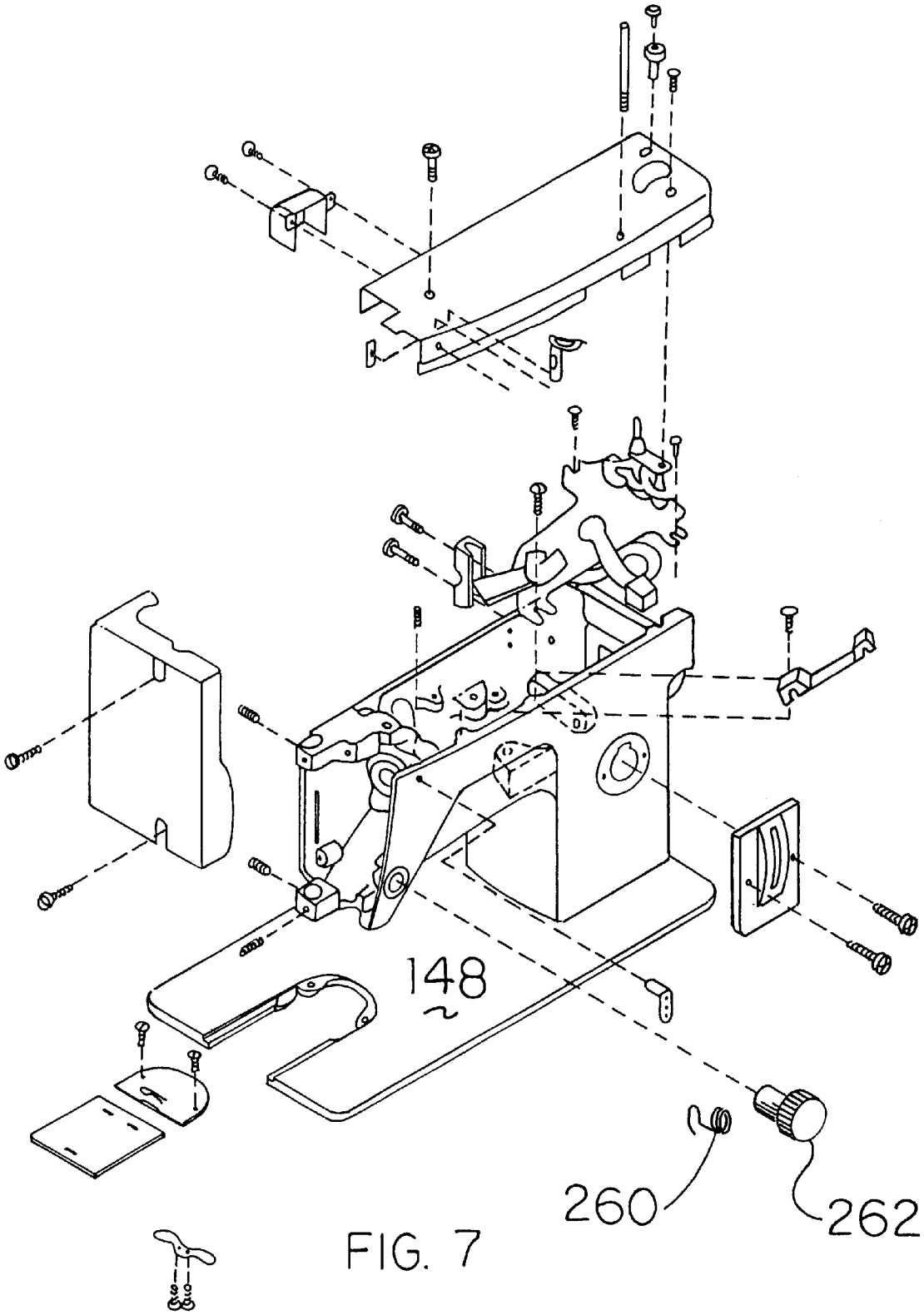
FIG. 7 is an exploded view of the external parts of the sewing machine and zigzag control lever with bobbin winder.
Figure 13:
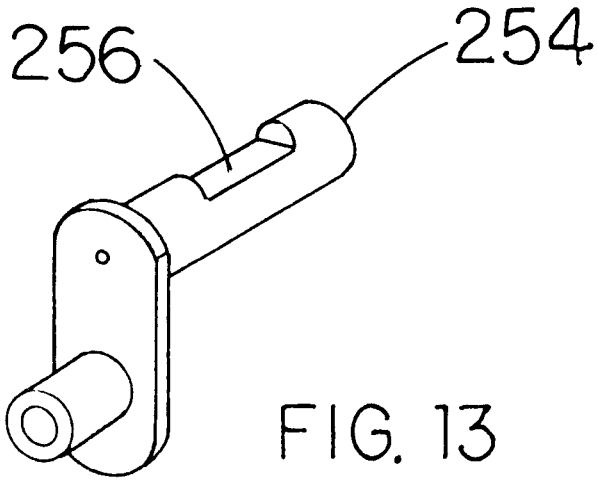
FIG. 13 is a perspective view of the needle crank rod.
Figure 15:
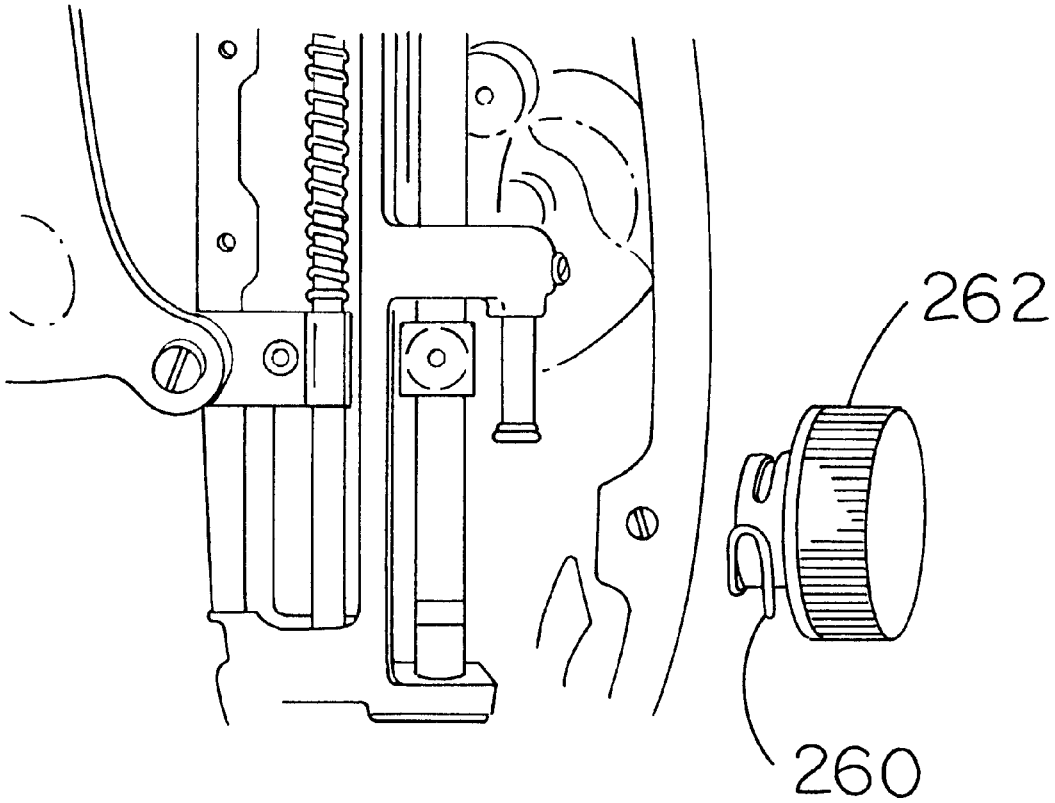
FIG. 15 is an enlarged end elevation view of the sewing machine illustrated in FIG. 1 illustrating the highest position of the needle bar stroke.
Figure 16:
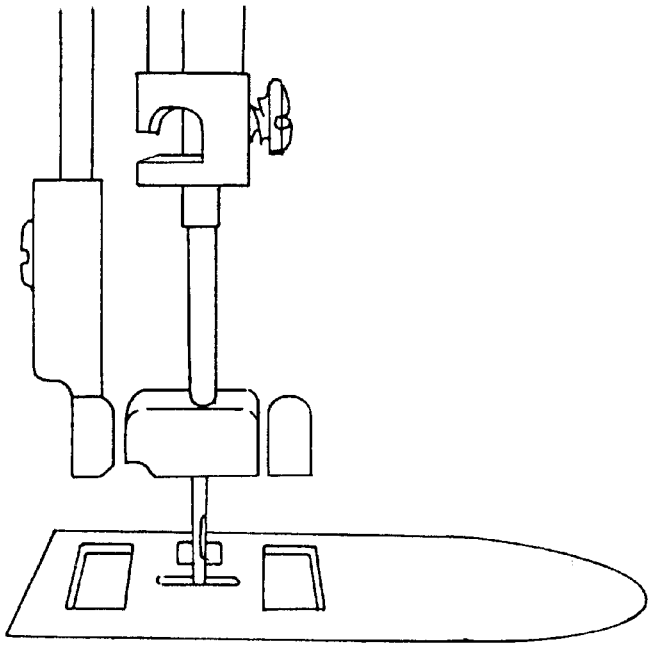
FIG. 16 is an enlarged front side view of the needle, presser foot and needle plate of the sewing machine illustrated in FIG. 1.
Figure 17:
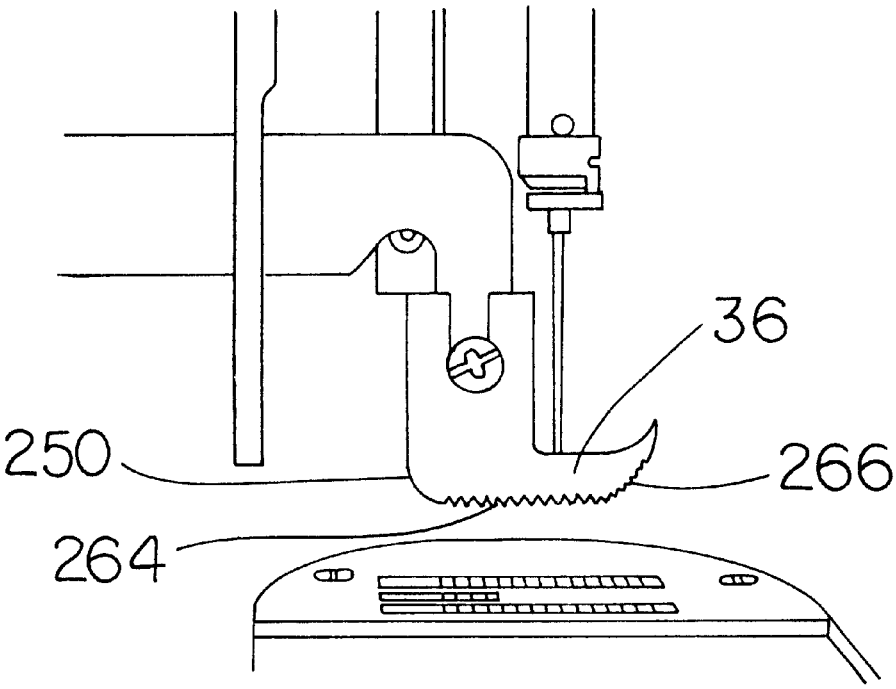
FIG. 17 is an enlarged partial front end elevation view of the needle, presser foot and needle plate of the sewing machine illustrated in FIG. 1.
Figure 18:
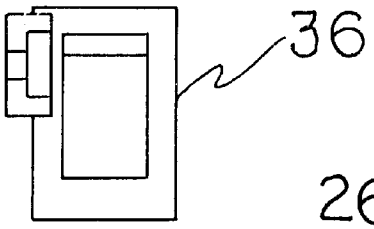
FIG. 18 is a top view of the outer view of the outer presser foot of the invention.

Specifically, an increased needle stroke is accomplished by modifying the needle crank rod 254 to have a shaft flat 256 machined on the stud thereof as shown in FIG. 13. Needle crank rod 254 is then secured to the crank rod by a set screw 258 shown in FIGS. 8 and 12. The increased stroke of the needle bar requires a commensurate reduction in the size of the take up spring 260 on the thread tension adjustment knob 262 as shown in FIG. 7.

Figure 19:
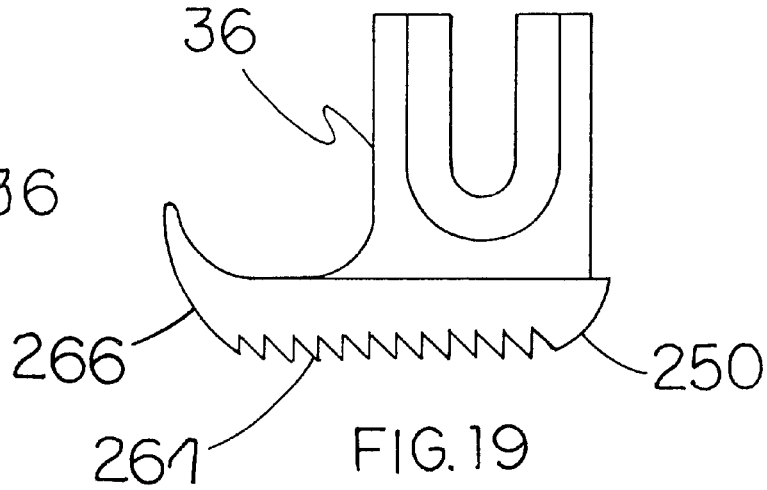
FIG. 19 is a side view of the outer presser foot of the invention.
Figure 20:
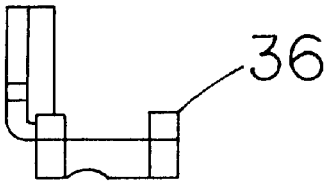
FIG. 20 is a front view of the outer presser foot of the invention.
Figure 21:
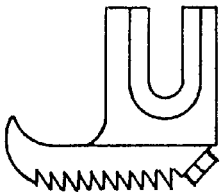
FIG. 21 is a side view of the outer presser foot of the invention.

To feed the material beneath the needle both fore and aft and to keep the workpiece from shifting side to side, the outer presser or walking foot 244 is increased in size to increase the surface area between the feed dog and the presser foot 244. The outer presser foot 244 is shaped to rock to accommodate the walking action of the foot. In a specific embodiment, this rocker action of the foot is accommodated by the radiused base 264 and distal 266 ends as shown in FIGS. 17–21. While the rocker foot has a number of radiuses associated therewith as shown in FIG. 19, the radius 264 and the radius 266 are those critical radiuses.

The inner presser foot 246 is also provided as shown with a low vertical height and radiuses both 280 and 282. The low vertical height allows this presser foot to be lifted relatively high permitting the insertion and removal of relatively thick fabrics. In a specific embodiment, fabrics up to 5/16 of an inch may be used with an inner presser foot 246 rise of about 9.75 millimeters plus or minus 0.75 millimeters.

In addition, the needle opening 252 in the needle throat plate 250 has been enlarged to reduce the needle strikes with large needles in heavy fabric. This increased width was not heretofore possible as the fabric heretofore has had a tendency of being pressed into the opening by the needle. However, the inner presser foot 246 and the outer presser or walking foot 244 pinches the fabric both fore and aft of the needle opening preventing the fabric from being drawn down into the needle opening 252 by the needle thus allowing the larger opening 252. In a specific embodiment, the needle opening has width of approximately 3 millimeters plus or minus ½ millimeter.

The even sewing of heavy, thick fabrics by the sewing machine 2 finally is accomplished by utilizing a cam on the top shaft for driving the walking foot 36 up and down. The cam utilizes a spring loaded connecting rod 268 having a C-shaped end 270 that surrounds a cam 242 on the upper shaft which moves against a spring 272 between the C-shaped end 270 and a plate 274 supported by the housing allowing for the connecting rod 268 to be moved back and forth as the cam rotates against the bias of the spring 272. This drive system allows for the movement of the walking foot 36 up and down and to quiet the machine and eliminate the play normally associated with the standard connecting rod that features a collar that completely surrounds the cam.

In a specific embodiment, the preferred needle stroke was increased to 34 millimeters from a relatively standard 30 millimeters. This 34 millimeters has an operable range of plus or minus 2 millimeters. The increased needle stroke requires the take up spring 260 to be reduced in size to approximately 0.5 millimeters. To accomplish the 34 millimeter travel of the needle stroke, the shaft flat 256 on the needle crank rod 254 was machined at a 13° plus or minus 0.5° angle to the horizontal as shown in FIG. 13.

In a specific embodiment, the walking foot 36 was increased in width to 18.4 millimeters plus or minus 0.2 millimeters. To allow the material to fed evenly from side to side front to back by this enlarged foot, the foot is caused to rock to accommodate its walking action, this walking action being accommodated by a radiused base 264 from about 100 millimeters to about 104 millimeters and radius distal end 266 from about 10 millimeters. The heel end 266 radius is about 7 millimeters.

Figure 23:
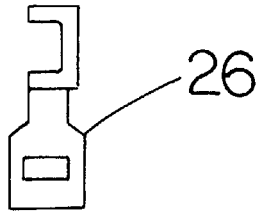
FIG. 23 is a top view of the inner presser foot of the invention.
Figure 25:
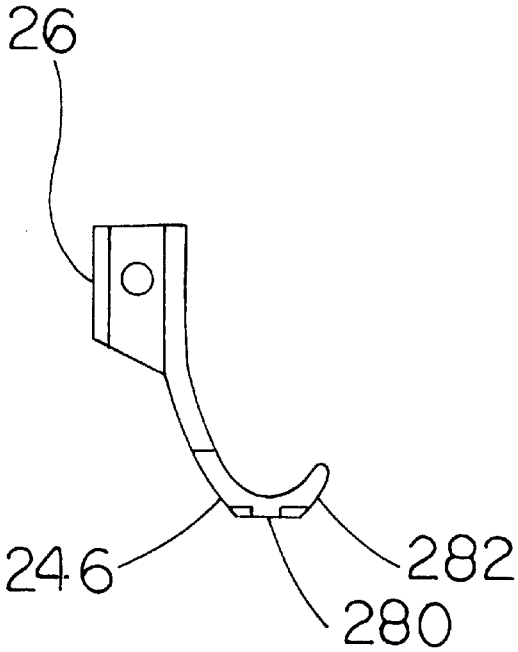
FIG. 25 is a view like FIG. 17 with the presser foot in its operating position.
Figure 24:
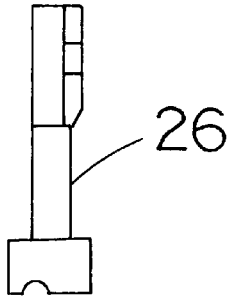
FIG. 24 is a front view of the inner presser foot of the invention.
Figure 26:
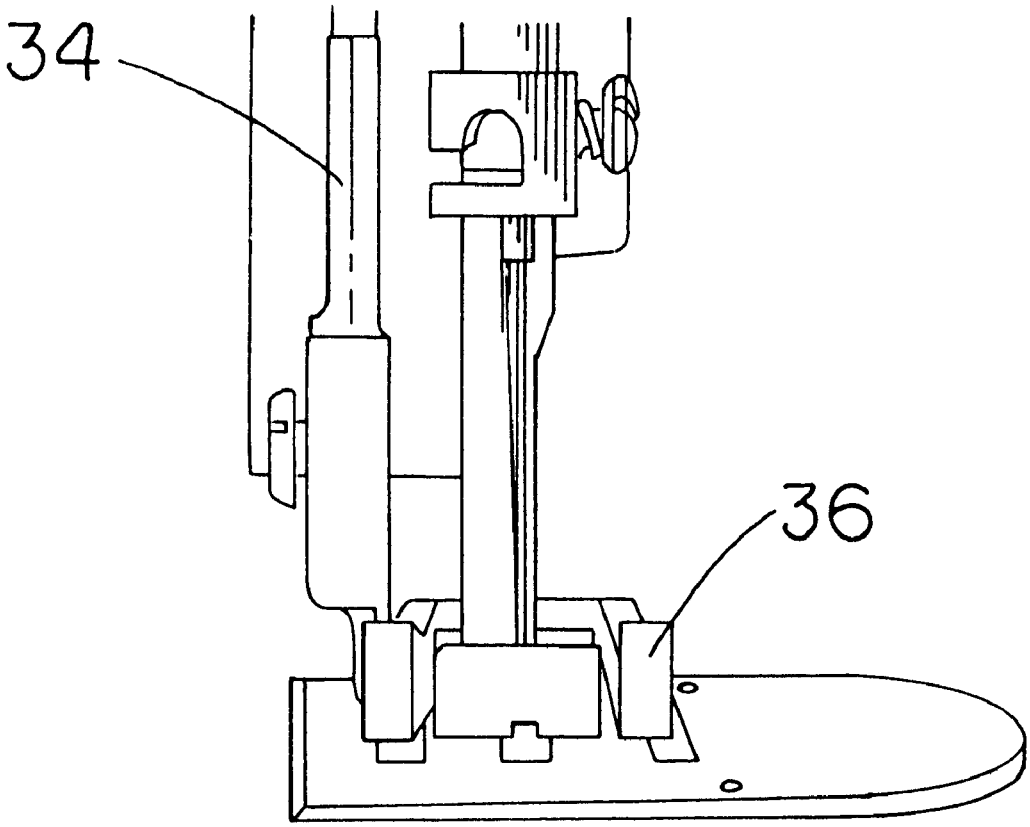
FIG. 26 is a partial front side view of the inner presser foot and outer presser foot of the invention.
Figure 30:
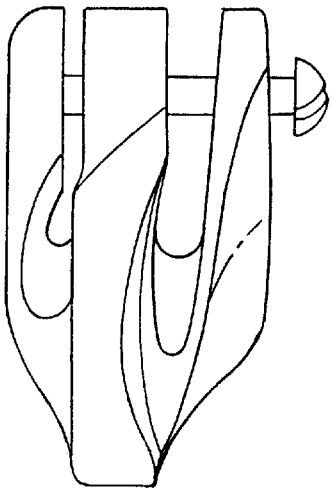
FIG. 30 is a side illustration of the hook detail of the sewing machine illustrated in FIG. 1 showing the needle clearance scarf.

In order to accommodate the above increased needle stroke and stitch length, a modification of the hook 276 shown in FIG. 9 is also required. The hook 276 utilized is provided with a cutout or scarf 278 shown in FIG. 30 to prevent needle strikes as the needle is moving downwardly and the hook is rotating back. Needle strikes are common in this area when sewing heavy materials as the needle driver mechanism bends out of vertical due to the effort required for the needle to penetrate the material. The inner presser foot 26 is also modified to have a precise radius 280 on the bottom thereof to focus pressure on the needle plate when the needle is withdrawn to better form a more consistent loop on the underside of the fabric thus eliminating a primary cause of skipped stitches in heavy fabrics. In a specific embodiment, radius 280 ranges from about 35 millimeters to about 36 millimeters. A precise radius on the distal ends 282 of the presser foot when the needle is penetrating the material. In a specific embodiment, radius 282 is about 10 millimeters. The heel end 246 radius is about 5 millimeters as shown in FIGS. 23 through 25.

Figure 31:
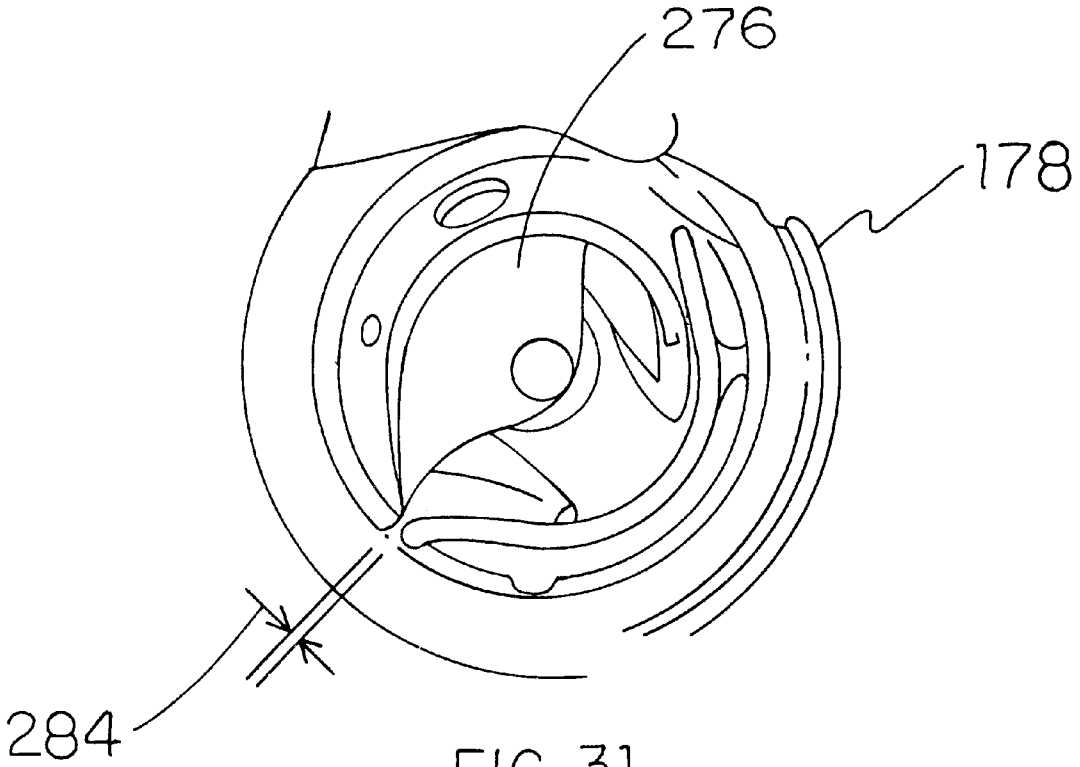
FIG. 31 is an end view of the hook driver assembly of the sewing machine shown in FIG. 1.

As shown in FIG. 31, the hook driver is designed to eliminate the need of stand off spring. The precise dimensions of the driver were chosen to provide a gap from about 0.5 to about 0.8 millimeters. By eliminating the spring, birds nests that often plague this type of machine upon start up are eliminated. Also, the sewing of complicated patterns with many twists and turns is made possible by the elimination of the stand off spring. The presence of the stand up spring in the past has practically required sewing in a straight line to avoid thread jams. In a specific embodiment, the cut out or scarf 278 of the hook 276 has a radius from about 14 millimeters to about 15.5 millimeters and has a depth of about 2.25 millimeters to about 3 millimeters. The throw mechanism 178 shown in FIG. 3 has dimensions to provide a gap 284 as shown in FIG. 31 from about 0.5 to about 0.8 millimeters.

In a specific embodiment, the width of the zigzag stitch is provided by the new presser foot 26 which allows for maximum lateral movement in the needle bar of 5 millimeters plus or minus 1 millimeter. This foot 26 which is powered by its link to the top shaft of the machine and in FIG. 17 as shown has sharp teeth in the bottom surface thereof to pull heavy fabrics along without slippage and with a desired accuracy. A special bobbin housing 166 is provided which is narrow enough to provide for the lateral movement of the mechanism. This lateral movement matches that of the needle 22. It has been found that it is not sufficient to increase the movement of the needle without increasing the movement of the thread bobbin housing 166. In a specific embodiment in which the movement of the needle 22 is matched with the movement of the bobbin housing 166, the bobbin housing is provided with a thickness from about 32 millimeters to about 34 millimeters.

Figure 32:
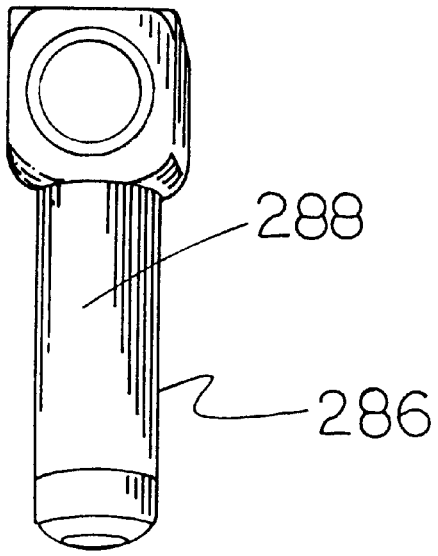
FIG. 32 is a perspective view of the needle bar stud of the sewing machine of the invention.
Figure 33:
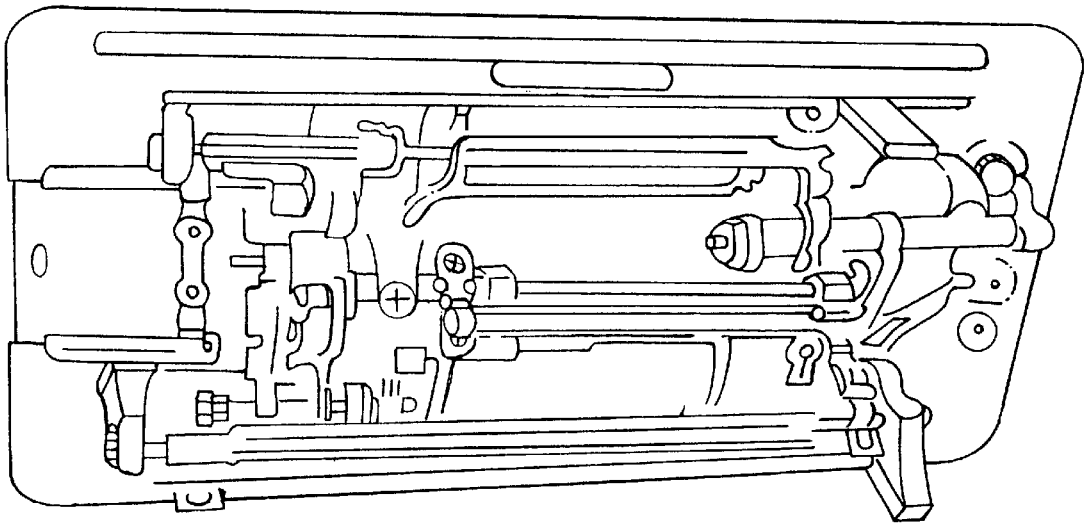
FIG. 33 is a bottom view of the sewing machine of the invention illustrated in FIG. 1.
Figure 34:
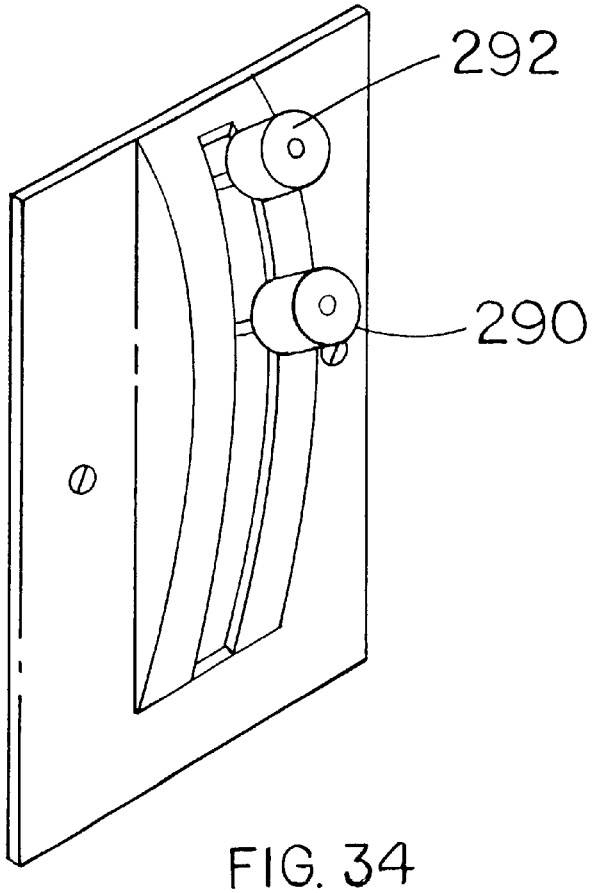
FIG. 34 is the stitch length adjustable stop mechanism of the new and improved sewing machine shown in FIG. 1.

The lateral movement of the needle bar 20 is provided by elongating the needle bar 20 connecting stud 286 as shown in FIG. 32. This connecting stud 286 is provided with a shaft 288 portion having a length of about 20.75 millimeters plus or minus 0.25 millimeters. See FIG. 32. The shaft 288 portion has a diameter of about 7.91 millimeters plus or minus 0.01 millimeters. The increased length of the shaft 288 allows for the increased lateral movement of the needle bar 20 aid thus is about 5 millimeters plus or minus 1 millimeter. Suitable clearance between the throw mechanism 178 and the end of the throw rod 182 allows for movement to create the increased lateral movement of the needle bar 20. Thus this clearance is also in a specific embodiment 5 millimeters plus or minus 1.

Figure 36:
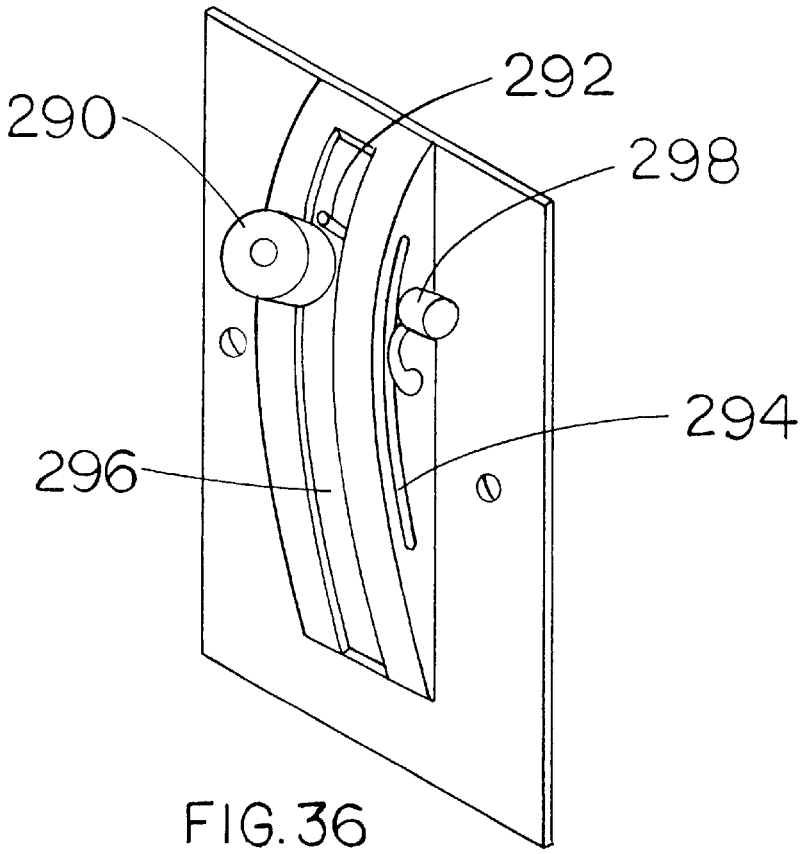
FIG. 36 is a perspective view of the stitch length mechanism and lock of the sewing machine shown in FIG. 1.
Figure 37:
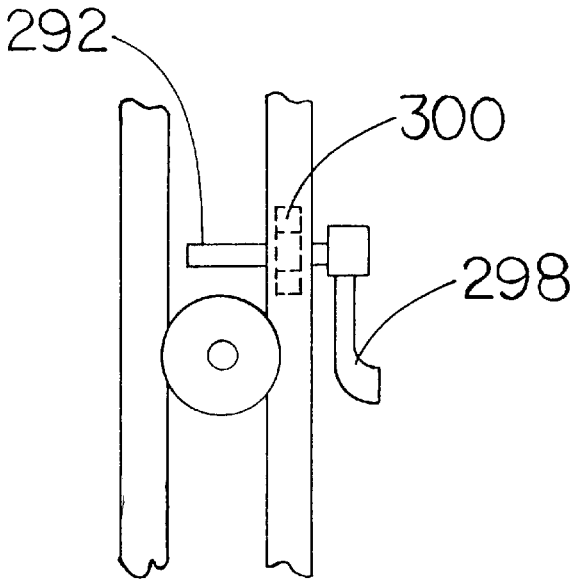
FIG. 37 is a partial front side cross-sectional view of the lockable cam to adjust the stitch length stop of the new and improved sewing machine of the invention.

To accommodate precise control of stitch length variability, it is highly desirable to provide an adjustable stitch length lever 290 and an adjustable stitch length stop 292. Adjustable length stop 292 is accomplished by providing a milled slot 294 along the ridge of the lever slot 296 through which a lever arm 298 can be inserted. See FIG. 36. This arm will have a cam 300 and/or a threaded nut 300 to allow it to be, locked in place with a simple half turn as shown in FIG. 36. When it is locked it will prevent the stitch length lever 290 from being raised beyond the distal end of the the lever arm 298. The stop lever arm 298 can be moved the entire length of the milled slot 294 to provide a stop 292 at any position from end to end.

Figure 35:
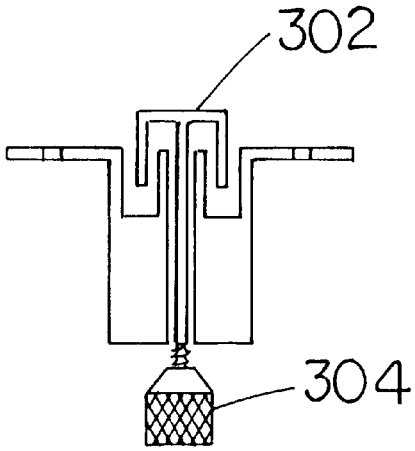
FIG. 35 is cross-sectional view of the tightenable knob to lock the stitch length lever in place.

To accomplish variable set stitch lengths between the stops the stitch length lever 290 is provided with a back stop 302 and a threaded knob 304 which when the knob is tightened pulls the back stop together locking it in position as shown in FIG. 35.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. An improved zigzag sewing machine with a walking foot capable of sewing heavy material having a main crank shaft coupled to a primary lift shaft and to a primary feed shaft and further having a feed dog for feeding a workpiece across a workpiece supporting surface in which the feed dog is mounted, and further comprising a needle bat assembly, having a needle plate through which the needle is driven, a hook and bobbin assembly beneath the workpiece supporting surface which moves with the needle bar assembly, and has a needle stroke take-up spring and a walking presser foot having an outer walking foot and an inner presser foot, said apparatus comprising a needle bar drive assembly having an increased needle stroke providing for penetration and removal of the needle from heavy material, an enlarged opening in the needle plate avoiding all needle strikes, means for holding the fabric on said workpiece supporting surface fore and aft said enlarged opening, whereby penetration of the fabric and withdrawal from the fabric can be accomplished without drawing the fabric into the opening of said needle plate.

2. The sewing machine of claim 1 wherein said inner presser foot may be lifted permitting the insertion and removal of heavy material.

3. The sewing machine of claim 1 wherein said increased needle stroke includes an increased stitch length and a reduction in the thread take-up spring.

4. The sewing machine of claim 3 wherein said increased needle stroke is accomplished by a larger rotation of said needle crank rod.

5. The sewing machine of claim 1 wherein said means for holding said fabric is said presser foot.

6. The sewing machine of claim 5 wherein said presser foot is radiused at its base and at its distal end, said both radiuses impact said heavy material.

7. The sewing machine of claim 6 wherein said presser foot has a base radius from about 35 millimeters to about 36 millimeters and a total radius from about 10 millimeters at its front toe to about 5 millimeters at its heel.

8. The sewing machine of claim 5 wherein said presser foot can be raised a greater distance than the thickness of said heavy material.

9. The sewing machine of claim 5 wherein said presser foot and said feed dog feeds said fabric from front to back and from side to side by a rocking motion upon said radiuses.

10. The sewing machine of claim 6 wherein said presser foot is driven from said main crank shaft by a spring biased cam follower.

11. The sewing machine of claim 10 wherein said spring biased cam follower is positioned on a cam secured to said shaft and said cam follower is C-shaped.

12. The sewing machine of claim 1 wherein said needle plate opening is greater than 3 millimeters from front to back.

13. The sewing machine of claim 1 wherein said needle plate opening is about 3 millimeters.

14. The sewing machine of claim 1 where said needle stroke is greater than 30 millimeters.

15. The sewing machine of claim 1 wherein said needle stroke is from about 32 millimeters to about 36 millimeters.

16. An apparatus having a main crank shaft coupled to a primary lift shaft and to a primary feed shaft and further comprising a bottom workpiece feed mechanism comprised of a feed dog disposed within a workpiece supporting surface of the machine and moved in the direction of feed and returned in the opposite direction by the oscillating motion of the primary feed shaft and also having a vertical oscillated needle bar, and still further having a feed foot attached to a presser bar for urging a workpiece against the workpiece supporting surface and feed dog, and in addition having a hook, whereby workpieces of extra thickness can be fed through said mechanism, maintained in alignment and stitched, said apparatus comprising a shuttle hook provided with a scarf in its periphery, said scarf eliminating needle strikes on said hook and a bobbin throw mechanism without a "stand-off spring."

17. The sewing machine of claim 16 wherein said scarf has a depth of about 2.5 millimeters.

18. The sewing machine of claim 16 wherein said scarf has a radius of about 14 millimeters.

19. An improved zigzag sewing machine with a walking foot capable of sewing heavy material having a main crank shaft coupled to a primary lift shaft and to a primary feed shaft and further having a feed dog for feeding a workpiece across a workpiece supporting surface in which the feed dog is mounted, having a needle bar assembly having a needle plate through which the needle is driven and a hook and bobbin assembly beneath the workpiece supporting surface which moves with the needle bar assembly and a walking presser foot having an outer walking foot and an inner presser foot, said apparatus comprising a needle bar drive assembly having a needle stroke providing for penetration and removal of the needle from thicker fabrics, an enlarged opening in the needle plate, a shuttle driver system that eliminates the need for a leaf spring filler device by controlling the gap between the driver and the shuttle,a stitch length adjustment, a hook driver assembly narrow enough to permit lateral movement to accommodate needle bar swing, and a stitch length stop which can be moved from end to end of said stitch length adjustment and secured in place at any position along said length.

20. The sewing machine of claim 19 wherein said stop has a lever, a threaded shaft and a nut for tightening said lever and securing said lever in position as desired.

21. The sewing machine of claim 19 wherein said gap between said shuttle hook and hook driver is spaced a sufficient amount to allow movement of said hook driver assembly in synchronization with said needle assembly.

22. The sewing machine of claim 19 wherein said hook driver assembly drive rod has sufficient clearance for movement of said hook and hook driver assembly in synchronization with said needle bar assembly.

23. The sewing machine of claim 19 wherein said gap between said shuttle and hook driver allows the passage of thread around the bobbin without requiring a spring leaf filler device.

24. An improved zigzag sewing machine with a walking foot capable of sewing heavy material having a main crank shaft coupled to a primary lift shaft and to a primary feed shaft and further having a feed dog for feeding a workpiece across a workpiece supporting surface in which the feed dog is mounted, having a needle bar assembly having a needle plate through which the needle is driven and a hook and bobbin assembly beneath the workpiece supporting surface which moves with the needle bar assembly, and a walking presser foot having an outer walking foot and an inner presser foot, said apparatus comprising a needle bar drive assembly having a needle stroke providing for penetration and removal of the needle from thicker fabrics, an enlarged opening in the needle plate avoiding all needle strikes, means for holding the fabric on said workpiece supporting surface before and aft said enlarged opening, whereby penetration of the fabric and withdrawal from the fabric can be accomplished without drawing the fabric into the opening of said needle plate, a stitch length adjustment lever, said lever having a lock thereon whereby said lever may be locked in any position between its two spaced apart most distal positions.

* * * * *